US007863236B2

(12) United States Patent
Kaschig et al.

(10) Patent No.: US 7,863,236 B2
(45) Date of Patent: Jan. 4, 2011

(54) DETERGENT COMPOSITIONS

(75) Inventors: Jürgen Kaschig, Freiburg (DE); Robert Hochberg, Merzhausen (DE); Oliver Becherer, Schwörstadt (DE); Gerhard Merkle, Freiburg (DE); Monika Schaumann, Lörrach (DE); Bernard Schultz, St. Louis (FR)

(73) Assignee: Ciba Specialty Chemicals Corp., Tarrytown, NY (US)

( * ) Notice: Subject to any disclaimer, the term of this patent is extended or adjusted under 35 U.S.C. 154(b) by 1017 days.

(21) Appl. No.: 10/548,359

(22) PCT Filed: Mar. 15, 2004

(86) PCT No.: PCT/EP2004/050307

§ 371 (c)(1),
(2), (4) Date: Mar. 6, 2006

(87) PCT Pub. No.: WO2004/085594

PCT Pub. Date: Oct. 7, 2004

(65) Prior Publication Data

US 2006/0166850 A1 Jul. 27, 2006

(30) Foreign Application Priority Data

Mar. 24, 2003 (EP) ..... 03100741

(51) Int. Cl.

| | |
|---|---|
| ***C11D 1/00*** | (2006.01) |
| ***C11D 1/66*** | (2006.01) |
| ***C11D 3/28*** | (2006.01) |
| ***C11D 3/39*** | (2006.01) |

(52) U.S. Cl. ..... 510/324; 510/394; 510/500; 510/505; 252/301.23; 252/301.26; 252/301.31; 252/301.32; 8/111; 8/137

(58) Field of Classification Search ..... 510/324, 510/394, 500, 505; 252/301.23, 301.26, 252/301.31, 301.32; 8/111, 137
See application file for complete search history.

(56) References Cited

U.S. PATENT DOCUMENTS

| | | | | |
|---|---|---|---|---|
| 3,655,574 | A | 4/1972 | Frischkorn et al. | 252/301.2 |
| 5,518,657 | A | 5/1996 | Fringeli et al. | 252/301.23 |
| 6,165,973 | A | 12/2000 | Baker | 510/516 |
| 2004/0074021 | A1 | 4/2004 | Farrar et al. | 8/648 |

FOREIGN PATENT DOCUMENTS

| | | |
|---|---|---|
| EP | 0 008 669 | 3/1980 |
| EP | 0 542 677 | 5/1993 |
| EP | 1 335 001 | 9/2002 |
| JP | 2001/254100 A | 9/2001 |
| WO | 98/23720 | 6/1998 |
| WO | 00/46336 | 8/2000 |
| WO | 02/055646 | 7/2002 |
| WO | 03/070869 | 8/2003 |
| WO | 2004/046293 | 6/2004 |

OTHER PUBLICATIONS

English language abstract from esp@cenet web site printed Jan. 23, 2006 of EP 1 335 001.
English language abstract, an 2002-064325[09] of JP 2001/254100, (Sep. 2001).
English language abstract from esp@cenet web site printed Jan. 23, 2006 of EP 0 008 669.

*Primary Examiner*—Gregory R Del Cotto
(74) *Attorney, Agent, or Firm*—Shiela A. Loggins

(57) ABSTRACT

The present invention provides a detergent composition D comprising at least one compound of formula (1) together with at least one compound of formula (2) wherein all substituents have the meanings as defined in the claims; as well as a process using such detergent composition and mixtures comprising fluorescent whitening agents.

19 Claims, No Drawings

DETERGENT COMPOSITIONS

The present invention is directed to detergent compositions containing mixtures of fluorescent whitening agents, as well as to such mixtures of fluorescent whitening agents.

It is commonly known to use fluorescent whitening agents in detergent compositions. They exhaust during the treatment on to the material to be washed and, by virtue of their special light absorption/emission property, result in elimination of the yellowish shades.

However there is still a need to find improved fluorescent whitening agents for this application. It has now been found that mixtures of the following compounds of formulae (1) and (2), possess superior properties with regard to, for example, solubility, buildup, properties, light-fastness degree of whiteness, and also possess excellent white aspects in the solid state. Favourable results are even obtained at low washing temperatures.

Accordingly, the present invention provides, as a first aspect, a detergent composition D comprising at least one compound of formula (1)

(1)

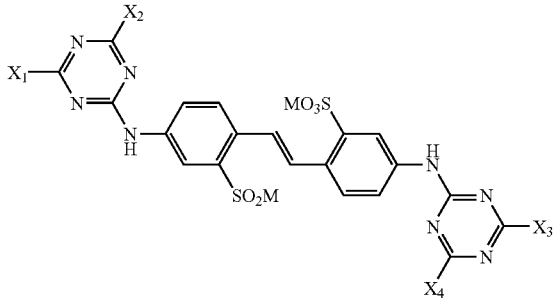

wherein $X_1$, $X_2$, $X_3$ and $X_4$ are —N($R_1$)$R_2$.

wherein $R_1$ and $R_2$ are independently from each other hydrogen; cyano; methyl;

substituted methyl; $CH_2CH_2OH$ or $C_5$-$C_7$cycloalkyl, or $R_1$ and $R_2$, together with the nitrogen atom linking them, form a heterocyclic ring, and M Is hydrogen or a cation, together with at least one compound of formula (2)

$NR_4R_4$ and/or $NR_5R_6$ form an unsubstituted or substituted morpholino ring, and M is hydrogen or a cation.

Within the scope of the above definitions, $C_1$-$C_8$alkyl may be methyl, ethyl, n- or isopropyl, n-, sec- or t-butyl, or linear or branched pentyl, hexyl, heptyl or octyl. Preferred are $C_1$-$C_4$alkyl groups. In case the alkyl groups are substituted examples of possible substituents are hydroxyl, phenyl, halogen, like fluorine, chlorine or bromine, sulfo, sulfato, carboxy and $C_1$-$C_4$alkyl, like methoxy and ethoxy. Other substituents of such alkyl groups are, for example, cyano and —$CONH_2$. Preferred substituents are hydroxy, carboxy, cyano, —$CONH_2$ and phenyl, especially hydroxy, phenyl and carboxy. Furthermore, highly preferred substituents are hydroxy, phenyl and $C_1$-$C_4$alkoxy, especially hydroxy and phenyl. The alkyl groups can also be uninterrupted or interrupted by —)— (in case of alkyl groups containing two or more carbon atoms).

Examples for $C_5$-$C_7$cycloalkyl groups are cyclopentyl and especially cyclohexyl. These groups can be unsubstituted or substituted by, for example, $C_1$-$C_4$-alkyl, like methyl. Preferred are the corresponding unsubstituted cycloalkyl groups.

Halogen may be fluorine, chlorine, bromine or iodine, preferably chlorine.

If $R_1$ and $R_2$ together with the nitrogen atom form a heterocyclic ring such a ring system can be, for example, morpholino, piperidine or pyrrolidine. The heterocyclic ring can be unsubstituted or substituted. An example for such substituents is $C_1$-$C_4$alkyl, especially methyl.

The cation M is preferably an alkali metal atom, an alkaline earth metal atom, ammonium or a cation formed from an amine. Preferred are Na, K, Ca, Mg, ammonium, mono-, di-, tri- or tetra-$C_1$-$C_4$alkylammonium, mono-, di- or tri-$C_2$-$C_4$-hydroxyalkylammonium or ammonium that is di- or tri-substituted with a mixture of $C_1$-$C_4$-alkyl and $C_2$-$C_4$-hydroxyalkyl groups. Highly preferred is sodium.

$R_1$ and $R_2$ are preferably independently from each other hydrogen; cyano; methyl; methyl which is substituted by hydroxy, cyano, —$CONH_2$, COOH or phenyl, especially by COOH; $CH_2CH_2OH$; unsubstituted or $C_1$-$C_4$alkyl-substituted $C_6$-$C_7$cycloalkyl, especially cyclohexyl; or $R_1$ and $R_2$, together with the nitrogen atom linking them, form an unsubstituted or $C_1$-$C_4$alkyl-substituted morpholino, piperidine or pyrrolidine ring.

(2)

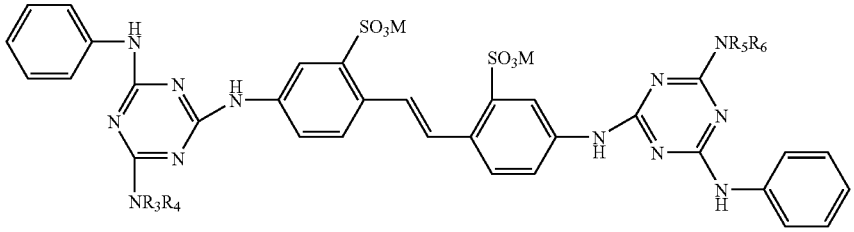

wherein $R_3$ and $R_5$, independently from each other, are hydrogen; unsubstituted $C_1$-$C_8$alkyl or substituted $C_1$-$C_8$alkyl, $R_4$ and $R_6$, independently from each other, are hydrogen; unsubstituted phenyl; unsubstituted $C_1$-$C_8$alkyl or substituted $C_1$-$C_8$alkyl, or More preferably, $R_1$ and $R_2$ are independently from each other hydrogen; methyl; COOH-substituted methyl; $CH_2CH_2OH$; unsubstituted or $C_1$-$C_4$alkyl-substituted $C_5$-$C_7$cycloalkyl, or $R_1$ and $R_2$, together with the nitrogen atom linking them, form an unsubstituted or $C_1$-$C_4$alkyl-substituted morpholino, piperidine or pyrrolidine ring. Highly preferred meanings for $R_1$ and $R_2$ are hydrogen, methyl or —$CH_2CH_2OH$, or $R_1$ and $R_2$, together with the nitrogen atom linking them, form an unsubstituted or $C_1$-$C_4$alkyl-substituted morpholino, piperidine or pyrrolidine ring. Most preferred are unsubstituted or $C_1$-$C_4$alkyl-substituted morpholino, piperidine or pyrrolidine rings, especially morpholino, formed by $R_1$ and $R_2$together with the nitrogen atom linking them.

Examples of —$N(R_1)R_2$ groups are —$NH_2$, —$NHCH_3$, —$N(CH_3)_2$, —$NH(CH_2CH_2OH)$, —$N(CH_2CH_2OH)_2$, —$NH(CH_2COOH)$, —$N(CH_3)(CH_2COOH)$, —NH(CN),

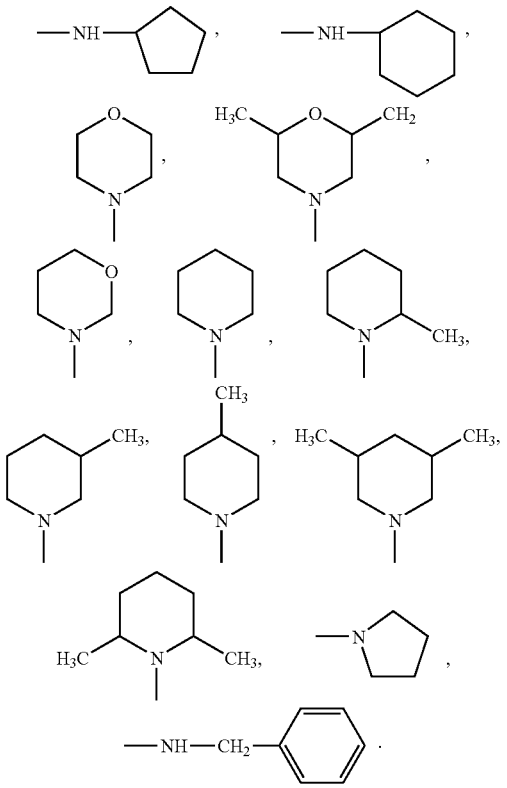

$CH_2CH_2OH$; unsubstituted or $C_1$-$C_4$alkyl-substituted $C_6$-$C_7$cycloalkyl; or $R_1$ and $R_2$, together with the nitrogen atom linking them, form an unsubstituted or $C_1$-$C_4$alkyl-substituted morpholino, piperidine or pyrrolidine ring.

Of particular interest are detergent compositions D comprising at least one compound of formula (1), wherein $X_1$ and $X_3$ are amino, and $X_2$ and $X_4$ are a radical of formula —$N(R_1)R_2$, wherein $R_1$ and $R_2$ are independently from each other hydrogen; unsubstituted or COOH or CN substituted methyl; $CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring.

Preferred are detergent compositions D comprising at least one compound of formula (2) wherein $R_3$ and $R_5$, independently of each other, are hydrogen; unsubstituted $C_1$-$C_4$alkyl or substituted $C_1$-$C_4$alkyl, $R_4$ and $R_5$, independently of each other, are unsubstituted phenyl; unsubstituted $C_1$-$C_4$alkyl or substituted $C_1$-$C_4$alkyl, or $NR_4R_4$ and/or $NR_6R_4$ form a morpholino ring, and M is hydrogen or an alkali metal atom, an alkaline earth metal atom, ammonium or a cation formed from an amine.

More preferred are detergent compositions D comprising at least one compound of formula (2) wherein $R_3$ and $R_5$, independently of each other, are hydrogen; unsubstituted $C_1$-$C_2$alkyl or $C_1$-$C_4$alkyl, which is substituted by hydroxy or $C_1$-$C_4$alkoxy, $R_4$ and $R_8$, independently of each other, are unsubstituted phenyl; unsubstituted $C_1$-$C_2$alkyl or $C_1$-$C_4$alkyl, which is substituted by hydroxy or $C_1$-$C_4$alkoxy, or $NR_4R_4$ and/or $NR_5R_6$ form a morpholino ring, and M is hydrogen or an alkali metal atom.

Especially preferred are detergent compositions D comprising at least one compound of formula (2a)

(2a)

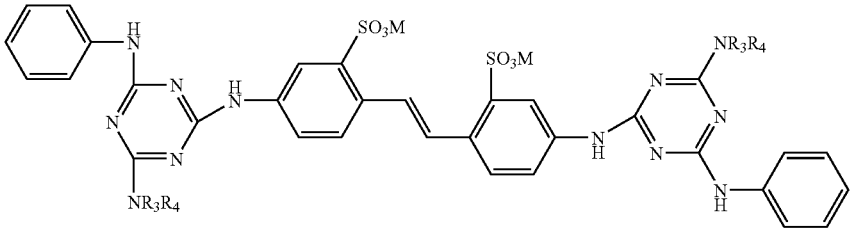

$X_1$ and $X_3$ have preferably the same meanings. In addition it is preferred that $X_2$ and $X_4$ have the same meanings. Furthermore, it is preferred that the four radicals $X_1$, $X_2$, $X_3$ and $X_4$ do not have identical meanings.

Preferred are detergent compositions D comprising at least one compound of formula (1), wherein $R_1$ and $R_2$ are independently from each other hydrogen; cyano; methyl which is unsubstituted or substituted by hydroxy, cyano, —$CONH_2$, —COOH or phenyl;

wherein $R_3$ is hydrogen; unsubstituted $C_1$-$C_2$alkyl or $C_1$-$C_4$alkyl, which is substituted by hydroxy or $C_1$-$C_4$alkoxy, $R_4$ is unsubstituted phenyl; unsubstituted $C_1$-$C_2$alkyl or $C_1$-$C_4$alkyl, which is substituted by hydroxy or $C_1$-$C_4$alkoxy, or $NR_4R_4$ forms a morpholino ring, and M is hydrogen or an alkali metal atom, preferably sodium.

Example of such preferred compounds of formula (2a) are those of formula (2b)-(2f)
(2b)
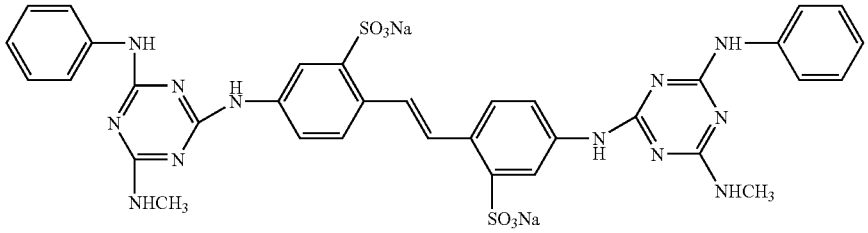
,
(2c)
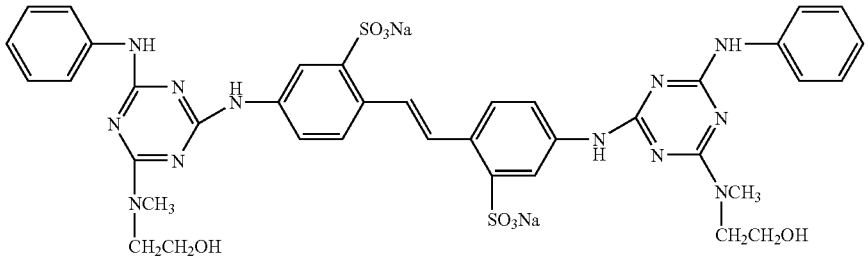
,
(2d)
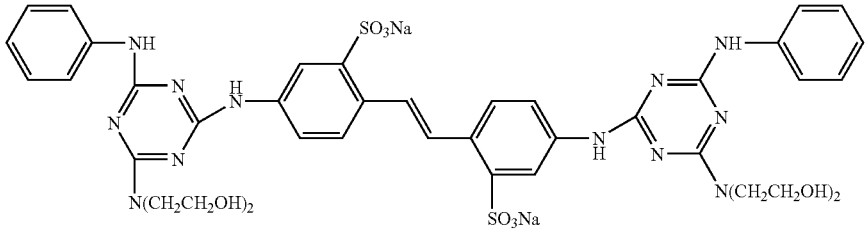
,
(2e)
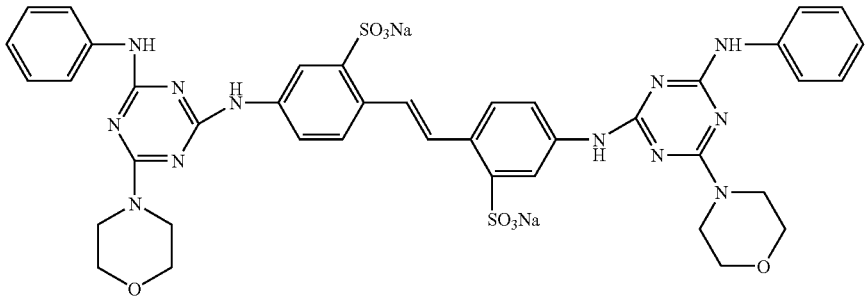
and
(2f)
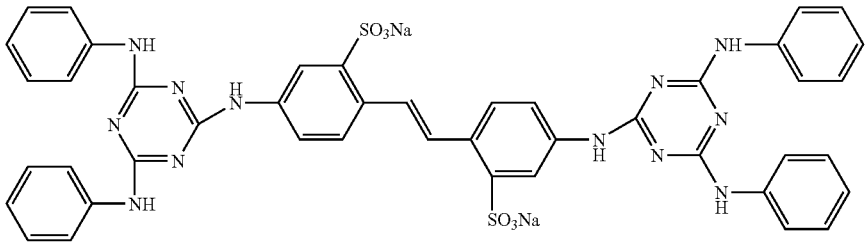
.

An especially preferred detergent composition D comprises at least one compound of formula (1')

(1')

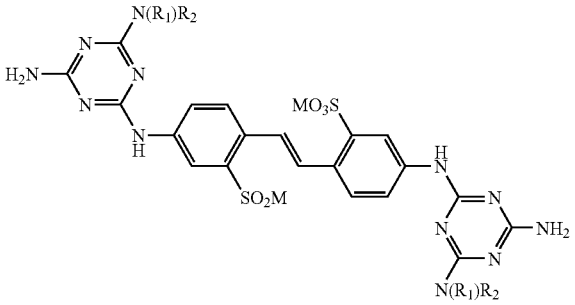

wherein $R_1$ and $R_2$ are independently from each other hydrogen; unsubstituted or COOH or CN substituted methyl; $CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and at least one compound of formulae (2b)-(2f)

(2b)

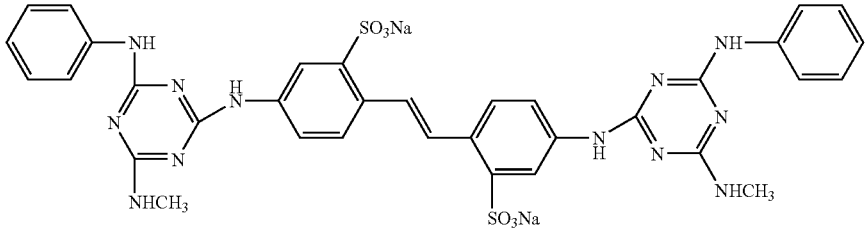

, (2c)

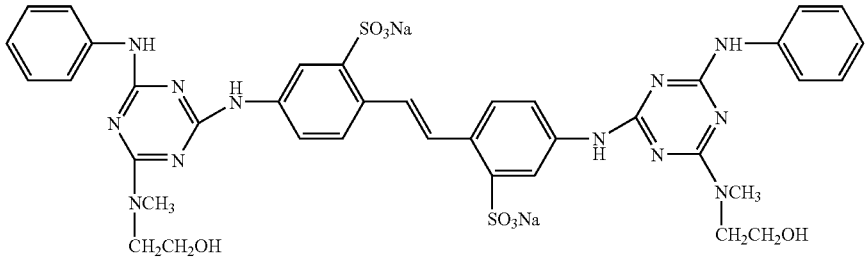

, (2d)

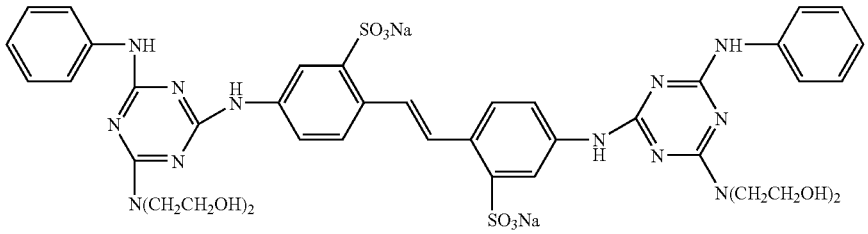

, (2e)

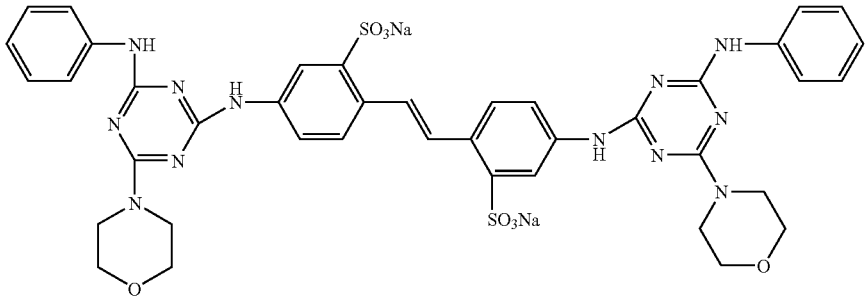

and/or

-continued (2f)

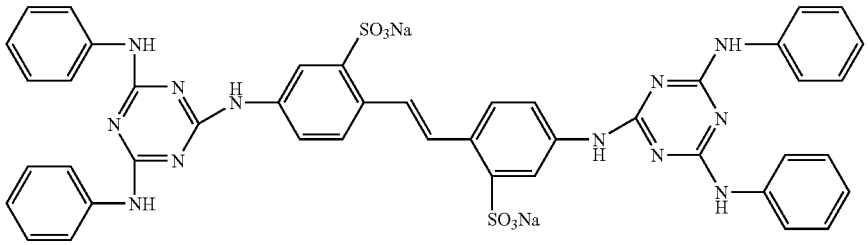

In the mixtures of compounds of formulae (1) or (1') and (2) or (2a) or (2b)-(2f) the molar ratio of compound (1) or (1') to compound (2) or (2a) or (2b)-(2f) is usually in the range of from 0.1:99.9 to 99.9:0.1, preferably from 1:99 to 99:1 and more preferably from 5:95 to 95:5.

Highly preferred is a molar ratio of from 10:90 to 90:10, especially 20:80 to 80:20. Most important is a molar ratio of from 30:70 to 70:30, especially 40:60 to 60:40.

The compounds of formulae (1) and (2) are known or can be prepared in analogy to known processes.

Compounds of formula (1) may be produced by reacting, under known reaction conditions, cyanuric chloride, successively, in any desired sequence, with each of 4,4-diaminostilbene-2,2'-disulfonic acid, and amino compounds capable of introducing the groups $X_1$, $X_2$, $X_3$ and $X_4$. Preferably, 2 moles of cyanuric chloride are initially reacted with 1 mole of 4,4'-diaminostilbene-2,2'-disulfonic acid and then reacting the intermediate obtained in any order with amino compounds capable of introducing the groups $X_1$, $X_2$, $X_3$ and $X_4$. For the preparation of compounds wherein $X_1$ and $X_3$ having the same meaning, and also $X_2$ and $X_4$ have the same meaning, it is preferred to react the intermediate obtained first with an amino compound capable of introducing $X_1$ and $X_3$, and, finally with an amino compound capable of introducing $X_2$ and $X_4$. It is also possible to carry out the reaction with the amino compounds in one step by reacting the intermediate with a mixture of amino compounds; in such a case usually corresponding mixtures of compounds of formula (1) are obtained.

The detergent compositions used preferably comprise i) 1-70 weight-% (wt-%) of at least one anionic surfactant and/or at least one nonionic surfactant;

ii) 0-75 wt-% of at least one builder, iii) 0-30 wt-% of at least one peroxide;

iv) 0-10 wt-% of at least one peroxide activator; and v) 0.001-5 wt-% of a mixture comprising at least one compound of formula (1) and at least one compound of formula (2), each by weight, based on the total weight of the detergent composition.

More preferably the detergent compositions used comprise i) 5-70 wt-% of at least one anionic surfactant and/or at least one nonionic surfactant ii) 5-70 wt-% of at least one builder, iii) 0.5-30 wt-% of at least one peroxide;

iv) 0.5-10 wt-% of at least one peroxide activator and/or 0.1-2% of a bleaching catalyst; and v) 0.01-5 wt-% of a mixture comprising at least one compound of formula (1) and at least one compound of formula (2), each by weight, based on the total weight of the detergent composition.

All preferences for the compounds of formula (1) and for the compounds of formula (2) defined above apply also for component v) of the detergent composition.

In general, an amount of a mixture comprising at least one compound of formula (1) and comprising at least one compound of formula (2) of 0.001-5 wt-%, especially an amount of 0.01-5 wt-% is used. Highly preferred is an amount of 0.05-5 wt-%, especially 0.05 to 2%. In general, amounts given in percent are to be understood as being percent by weight, based on the total weight of the detergent composition, unless otherwise stated.

The detergent composition may be formulated as a solid, as an aqueous liquid comprising, e.g., 5-50 wt-%, preferably 10-35 wt-% of water or as a non-aqueous liquid detergent, containing not more than 5 wt-%, preferably 0-1 wt-% of water, and based on a suspension of a builder in a non-ionic surfactant, as described; e.g., in GB-A-2158454.

The anionic surfactant component may be, e.g., an alkylbenzenesulfonate, an alkysulfate, an alkylethersulfate, an olefinsulfonate, an alkanesulfonate, a fatty acid salt, an alkyl or alkenyl ether carboxylate or an α-sulfofatty acid salt or an ester thereof. Preferred are alkylbenzenesulfonates having 10 to 20 carbon atoms in the alkyl group, alkylsulfates having 8 to 18 carbon atoms, alkylethersulfates having 8 to 18 carbon atoms, and fatty acid salts being derived from palm oil or tallow and having 8 to 18 carbon atoms. The average molar number of ethylene oxide added in the alkylethersulfate is preferably 1 to 20, preferably 1 to 10. The salts are preferably derived from an alkaline metal like sodium and potassium, especially sodium. Highly preferred carboxylates are alkali metal sarcosinates of formula $R—CO(R^1)CH_2COOM^1$ in which R is allyl or alkenyl having 9-17 carbon atoms in the alkyl or alkenyl radical, $R^1$ is $C_1$-$C_4$ alkyl and $M^1$ is an alkali metal, especially sodium.

The nonionic surfactant component may be, e.g., primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The total amount of anionic surfactant and nonionic surfactant is preferably 55 wt-%, preferably 5-40 wt-% and more preferably 5-30 wt-%. As to these surfactants it is preferred that the lower limit 110 wt-%, based on the total weight of the detergent composition.

The builder component may be an alkali metal phosphate, especially a tripolyphosphate; a carbonate or bicarbonate, especially the sodium salts thereof; a silicate or disilicate; an aluminosilicate; a polycarboxylate; a polycarboxylic acid; an organic phosphonate; or an aminoalkylene poly(alkylene phosphonate); or a mixture of these.

Preferred silicates are crystalline layered sodium silicates of the formula $NaHSi_mO_{2m+1}.pH_2O$ or $Na_2Si_mO_{2m+1}.pH_2O$ in which m is a number from 1.9 to 4 and p is 0 to 20.

Preferred aluminosilicates are the commercially-available synthetic materials designated as Zeolites A, B, X, and HS, or mixtures of these. Zeolite A is preferred.

Preferred polycarboxylates include hydroxypolycarboxylates, in particular citrates, polyacrylates and their copolymers with maleic anhydride.

Preferred polycarboxylic acids include nitrilotriacetic acid and ethylene diamine tetra-acetic acid.

Preferred organic phosphonates or aminoalkylene poly (alkylene phosphonates) are alkali metal ethane 1-hydroxy diphosphonates, nitrilo trimethylene phosphonates, ethylene diamine tetra methylene phosphonates and diethylene triamine penta methylene phosphonates.

The amount of builders is preferably 5-70 wt-%, preferably 5-60 wt-% and more preferably 10-60 wt-%. As to the builders it is preferred that the lower limit is 15 wt-%, especially 20 wt-%, based an the total weight of the detergent composition.

Suitable peroxide components include, for example, the organic and inorganic peroxides (like sodium peroxides) known in the literature and available commercially that bleach textile materials at conventional washing temperatures, for example at from 5 to 95° C.

In particular, the organic peroxides are, for example, monoperoxides or polyperoxides having alkyl chains of at least 1, preferably 2 to 20, carbon atoms; in particular peroxyacetic acid or diperoxydicarboxylates having 6 to 12 C atoms, such as diperoxyperazelates, diperoxypersebacates, diperoxyphthalates and/or diperoxydodecanedioates, especially their corresponding free acids, are of interest. It is preferred, however, to employ very active inorganic peroxides, such as persulphate, parborate and/or percarbonate. It is, of course, also possible to employ mixtures of organic and/or inorganic peroxides.

The amount of peroxide is preferably 0.5-30 wt-%, preferably 1-20 wt-% and more preferably 1-15 wt-%. in case a peroxide is used, the lower limit is preferably 2 wt-%, especially 5 wt-%, based on the total weight of the detergent composition.

The peroxides, especially the inorganic peroxides, are preferably activated by the inclusion of a bleach activator. Preferred are such compounds that, under perhydrolysis conditions, yield unsubstituted or substituted perbenzo- and/or peroxo-carboxylic acids having from 1 to 10 carbon atoms, especially from 2 to 4 carbon atoms. Suitable compounds include those that carry O— and/or N-acyl groups having the said number of carbon atoms and/or unsubstituted or substituted benzoyl groups. Preference is given to polyacylated alkylenediamines, especially tetraacetylethylenediamine (TAED), acylated glycolurils, especially tetraacetylglycoluril (TAGU), N,N -diacetyl-N,N-dimethyl-urea (DDU), acylated triazine derivatives, especially 1,5-diacetyl-2,4-dioxohexahydro-1,3,5-triazine (DADHT), compounds of formula

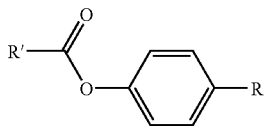

wherein R is a sulfonate group, a carboxylic acid group or a carboxylate group, and wherein R' is linear or branched ($C_7$-$C_{15}$)alkyl; also activators that are known under the names SNOBS, SLOBS, NOBS and DOBA, acylated polyhydric alcohols, especially triacetin, ethylene glycol diacetate and 2,5-diacetoxy-2,5-dihydrofuran and acetylated sorbitol and mannitol and acylated sugar derivatives, especially pentaacetylglucose (PAG), sucrose polyacetate (SUPA), pentaacetylfructose, tetraacetylxylose and octaacetyllactose, and acetylated, optionally N-alkylated, glucamine and gluconolactone. The combinations of conventional bleach activators disclosed in German Patent Application DE-A-44 43 177 may also be used. Nitrile compounds that form peroxyimidic acids with peroxides are also suitable as bleach activators. Preferred are tetraacetyl ethylenediamine and nonoyloxybenzene sulfonate.

The amount of bleach activator is preferably 0-10 wt-%, preferably 0-8 wt-%. In case a bleach activator is used, the lower limit is preferably 0.5 wt-%, especially 1 wt-%, based on the total weight of the detergent composiion.

Bleaching catalysts, which may be added, include, e.g., enzymatic peroxide precursors and/or metal complexes. Preferred metal complexes are manganese, cobalt or iron complexes such as manganese or iron phthalocyanines or the complexes described in EP-A-0509787. In case a bleaching catalyst is used the amount is preferably 0.005 to 2 wt-%, more preferably 0.01 to 2 wt-%, especially 0.05 to 2 wt-%. Highly preferred is an amount of 0.1-2 wt-%, based on the total weight of the detergent composition.

As examples for bleaching catalysts the following are mentioned:

WO-A-95/30681 (see i.e. formula (I) and the following definition on page 1, lines 7 to 30; especially formula (I) and the following definitions given on page 2, lines 29 to page 11, line 11). Preferred ligands are those given on page 13, line 12 to page 26, line 11.

WO-A-01/09276 (see i.e. formulae (1), (2) and (3) and the following definitions given on pages 2 and 3).

WO-A-01/05925 (see i.e. formula (1) and the following definition on page 1, last paragraph to page 2, first paragraph. The preferences given for the metal complexes apply, see especially those of formula (2) on page 3 and those of formula (3) on page 4).

WO-A-02/088289 (see i.e. formula (1) and the following definition on page 2. The preferences given for the metal complexes apply, see especially the ligands of formula (3) and also the preferences given on page 3, fourth paragraph to page 4, paragraph 7).

Furthermore, the detergent compositions can optionally contain enzymes. Enzymes can be added to detergent compositions for stain removal. The enzymes usually improve the performance on stains that are either protein- or starch-based, such as those caused by blood, milk, grass or fruit juices. Preferred enzymes are cellulases, proteases, amylases and lipases. Preferred enzymes are cellulases and proteases, especially proteases. Cellulases are enzymes which act on cellulose and its derivatives and hydrolyze them into glucose, celloblose, cellooligosaccharide. Cellulases remove dirt and have the effect of mitigating the roughness to the touch. Examples of enzymes to be used include, but are by no means limited to, the following:

proteases as given in U.S. Pat. No. 6,242,405, column 14, lines 21 to 32;

lipases as given in U.S. Pat. No. 6,242,405, column 14, lines 33 to 46;

amylases as given in U.S. Pat. No. 6,242,405, column 14, lines 47 to 56; and cellulases as given in U.S. Pat. No. 6,242,405, column 14, lines 57 to 64.

The enzymes can optionally be present in the detergent compositions. When used, the enzymes are usually present in an amount of 0.01-5 wt-%, preferably 0.05-5 wt-% and more preferably 0.1-4 wt-%, based on the total weight of the detergent composition.

Further preferred additives for the detergent compositions according to the invention are polymers that, during the washing of textiles, inhibit staining caused by dyes in the washing liquor that have been released from the textiles under the washing conditions (dye fixing agents, dye transfer inhibitors). Such polymers are preferably polyvinylpyrrolidones, polyvinylimidazoles or polyvinylpyridine N-oxides which may have been modified by the incorporation of anionic or cationic substituents, especially those having a molecular weight in the range from 5000 to 60 000, more especially from 10 000 to 50 000. Such polymers are usually used in an amount of from 0.01 to 5 wt-%, preferably 0.05 to 5 wt-%, especially 0.1 to 2 wt-%, based on the total weight of the detergent composoition. Preferred polymers are those given in WO-A-02/02865 (aee especially page 1, last paragraph and page 2, first paragraph).

The detergent compositions used will usually contain one or more auxillaries such as soil suspending agents, for example sodium carboxymethylcellulose; salts for adjusting the pH, for example alkali or alkaline earth metal silicates; foam regulators, for example soap; salts for adjusting the spray drying and granulating properties, for example sodium sulphate; perfumes; and also, if appropriate, antistatic and softening agents; such as smectite clays; photobleaching agents; pigments; and/or shading agents. These constituents should, of course, be stable to any bleaching system employed. Such auxiliaries can be present in an amount of, for example, 0.1 to 20 wt-%, preferably 0.5 to 10 wt-%, especially 0.5 to 5 wt-%, based on the total weight of the detergent composition.

The detergent compositions can take a variety of physical forms induding powder, granular, tablet and liquid forms. Examples thereof are conventional powder heavy-duty detergents, compact and supercompact heavy-duty detergents and tablets, like heavy-duty detergent tablets. One important physical form is the so-called concentrated granular form adapted to be added to a washing machine.

Of importance are also the so-called compact (or supercompact) detergents. In the field of detergent manufacture, a trend has developed recently towards the production of compact detergents, which contain increased amounts of active substance. In order to minimize energy expenditure during the washing process, the compact detergents are required to operate efficiently at temperatures as low as 40° C., or even at room temperatures, e.g. at 25° C. Such detergents usually contain only low amounts of fillers or processing aids, like sodium sulfate or sodium chloride. The amount of such fillers is usually 0-10 wt-%, preferably 0-5 wt-%. especially 0-1 wt-%, based on the total weight of the detergent composition. Such detergent compositions usually have a bulk density of 650-1000 g/l, preferably 700-1000 g/l and especially 750-1000 g/l.

The detergent compositions can also be present in the form of tablets. Relevant characteristics of tablets are ease of dispensing and convenience in handling. Tablets are the most compact delivery of solid detergents and have a bulk density of, for example, 0.9 to 1.3 kg/liter. To enable fast disintegration laundry detergent tablets generally contain special disintegrants:

Effervescents such as carbonate/hydrogencarbonate/citric acid;

swelling agents like cellulose, carboxymethyl cellulose, cress4inked poly(N-vinylpyrrollidone);

quickly dissolving materials such as Na(κ) acetate, or Na(κ) citrate;

rapidly dissolving water-soluble rigid coating such as dicarboxy acids.

The tablets can also contain combinations of any of the above disintegrants.

The detergent composition may also be formulated as an aqueous liquid comprising 6-50 wt-%, preferably 10-35 wt-% or as a non-aqueous liquid detergent, containing not more than 5 wt-%, preferably 0-1 wt-% of water, based on the total weight of the detergent composition. Non-aqueous liquid detergent compositions can contain other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5 to 90 wt-%, typically 10 to 50 wt-% of such carriers, based on the total weight of the detergent composition. The detergent compositions can also be present as the so-called "unit liquid dose" form.

An especially preferred detergent composition comprises i) 5-70 wt-% of at least one anionic surfactant and/or at least one nonionic surfactant ii) 5-70 wt-% of at least one builder;

iii) 0.5-30 wt-% of at least one peroxide;

iv) 0.5-40 wt-% of at least one peroxide acthiator and/or 0.1-2% of a bleaching catalyst and v) 0.01-5 wt-% of a mixture comprising at least one compound of formula (1')

(1')

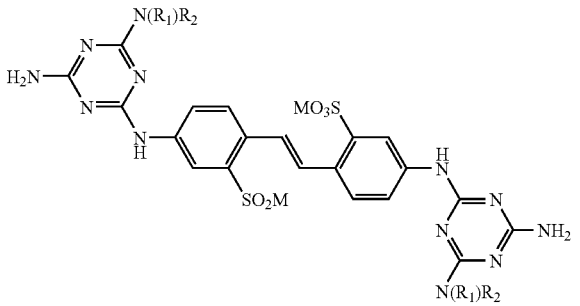

wherein $R_1$ and $R_2$ are hydrogen; unsubstituted or COOH or CN substituted methyl;

$CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and at least one compound of formulae (2b)-(2f)

(2b)

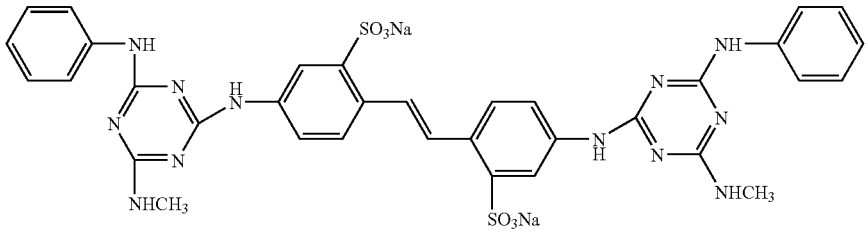

, (2c)

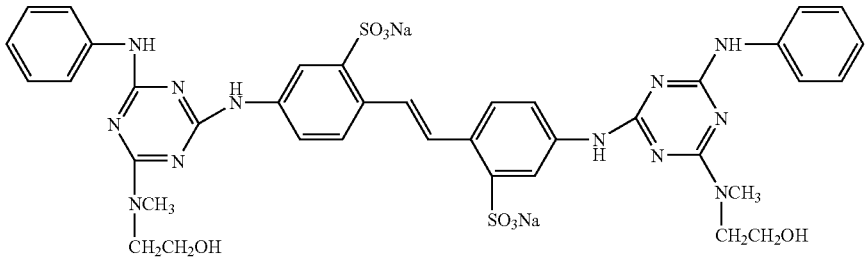

, (2d)

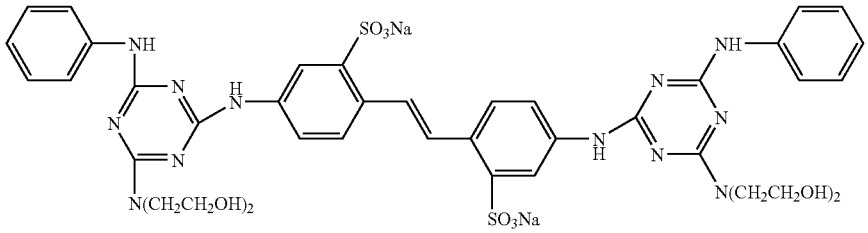

, (2e)

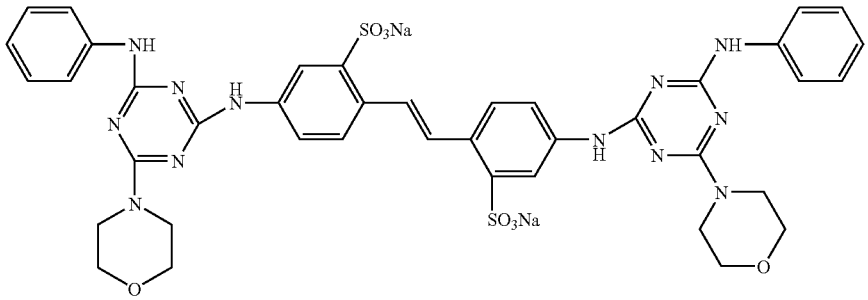

and/or (2f)

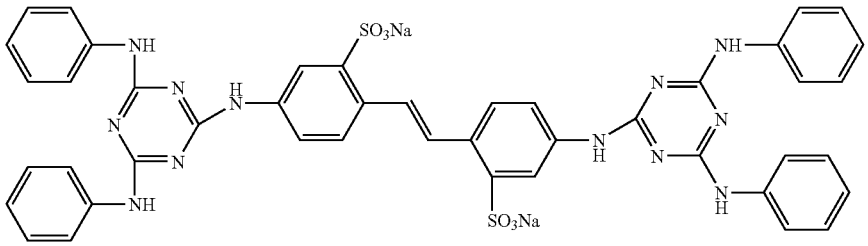

.

each by weight, based on the total weight of the detergent composition.

In the mixtures of compounds of formulae (1) or (1') and (2) or (2a) or (2b)-(2f) the molar ratio of compound (1) or (1') to compound (2) or (2a) or (2b)-(2f) is usually in the range of from 0.1:99.9 to 99.9:0.1, preferably from 1:99 to 99:1 and more preferably from 5:95 to 95:5. Highly preferred is a molar ratio of from 10:90 to 90:10, especially 20:80 to 80:20. Most important is a molar ratio of from 30:70 to 70:30, especially 40:60 to 60:40.

Furthermore, the present invention is directed to a detergent composition D' comprising at least one compound of formula (1)

(1)

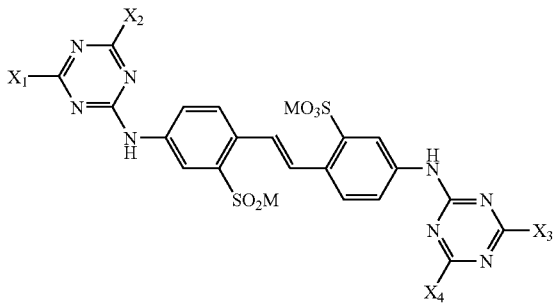

wherein $X_1$, $X_2$, $X_3$ and $X_4$ are, independently of each other, —N($R_1$)$R_2$, wherein $R_1$ and $R_2$ are independently from each other hydrogen; cyano; methyl which is unsubstituted or substituted by hydroxy, cyano, —$CONH_2$ or phenyl; $CH_2CH_2OH$;

unsubstituted or $C_1$-$C_4$alkyl-substituted $C_5$-$C_7$cycloalkyl; or $R_1$ and $R_2$, together with the nitrogen atom linking them, form an unsubstituted or $C_1$-$C_4$alkyl-substituted morpholino, piperidine or pyrolidine ring; and M is hydrogen or a cation, together with at least one compound of formula (2)

As to the compounds of formula (1) and (2) as well as to the substituents thereof the meanings and preferences given above apply.

Preferred am detergent compositions D' comprising at least one compound of formula (1), wherein $R_1$ and $R_2$ are independently from each other hydrogen; cyano; methyl which is unsubstituted or substituted by hydroxy, cyano, —$CONH_2$, —COOH or phenyl; $CH_2CH_2OH$; unsubstituted or $C_1$-$C_4$alkyl-substituted $C_5$-$C_7$cycloalkyl; or $R_1$ and $R_2$, together with the nitrogen atom linking them, form an unsubstituted or $C_1$-$C_4$alkyl-substituted morpholino, piperidine or pyrrolidine ring.

Of particular interest are detergent compositions D' comprising at least one compound of formula (1), wherein $X_1$ and $X_3$ are amino, and $X_2$ and $X_4$ are a radical of formula —N(($R_1$)$R_2$, wherein $R_1$ and $R_2$ are independently from each other hydrogen; unsubstituted or COOH or CN substituted methyl; $CH_2CH_2OH$; unsubstituted or $C_1$-$C_1$-$C_4$alkyl-substituted cyclopentyl or cyclohexal, or $R_1$ and $R_2$, together with the nitrogen atom linking them, form an unsubstituted or $C_1$-$C_4$alkyl-substituted morpholino, piperidine or pyrrolidine ring.

Of interest are detergent composition D' comprising at least one compound of formula (2), wherein $R_3$ and $R_5$, independently of each other, are hydrogen; unsubstituted or substituted methyl, $R_5$ and $R_7$, independently of each other, are unsubstituted phenyl; unsubstituted or substituted methyl, or $NR_3R_4$ and/or $NR_6R_6$ form a morpholino ring, and M is hydrogen or a cation.

Of preferred interest are detergent composition D' comprising at least one compound of formula (2), wherein (2)

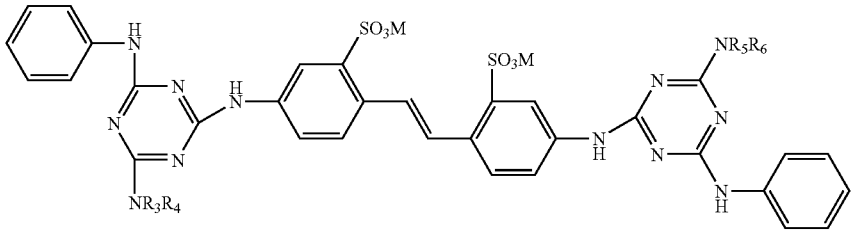

wherein $R_3$ and $R_5$, independently from each other, are hydrogen; unsubstituted $C_1$-$C_8$alkyl or substituted $C_1$-$C_8$alkyl, $R_4$ and $R_8$ independently from each other, are hydrogen; unsubstituted phenyl;

unsubstituted $C_1$-$C_8$alkyl or substituted $C_1$-$C_8$alkyl, or $NR_3R_4$ and/or $NR_5R_6$ form an unsubstituted or substituted morpholino ring, and M is hydrogen or a cation, and wherein the detergent composition contains at least one enzyme selected from the group consisting of cellulase, protease, amylase and lipase.

$R_3$ and $R_5$, independently of each other, are hydrogen; unsubstituted $C_1$-$C_2$alkyl or $C_1$-$C_4$alkyl, which is substituted by hydroxy or $C_1$-$C_4$alkoxy, $R_4$ and $R_6$, independently of each other, are unsubstituted phenyl; unsubstituted $C_1$-$C_2$alkyl or $C_1$-$C_4$alkyl, which is substituted by hydroxy or $C_1$-$C_4$alkoxy, or $NR_3R_4$ and/or $NR_5R_6$ form an unsubstituted or substituted morpholino ring, and M is hydrogen or a cation.

Of more preferred interest are detergent compositions D' comprising at least one compound of formula (2a)

(2a)

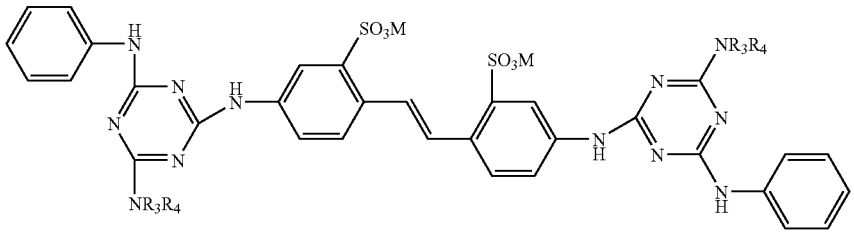

wherein $R_3$ is hydrogen; unsubstituted $C_1$-$C_2$alkyl or $C_1$-$C_4$alkyl, which is substituted by hydroxy or $C_1$-$C_4$alkoxy, $R_4$ is unsubstituted phenyl, unsubstituted $C_1$-$C_2$alkyl, or $C_1C_4$alkyl, which is substituted by hydroxy or $C_1$-$C_4$alkoxy or $NR_3R_4$ forms a morpholino ring, and M is hydrogen or an alkali metal atom, preferably sodium.

Of special interest are compounds of formula (2a) are those of formula (2b)-(2f)

(2b)

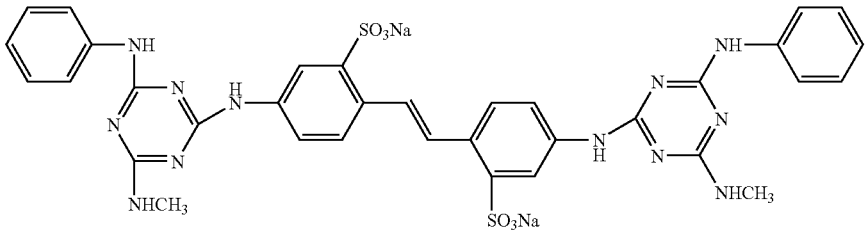

, (2c)

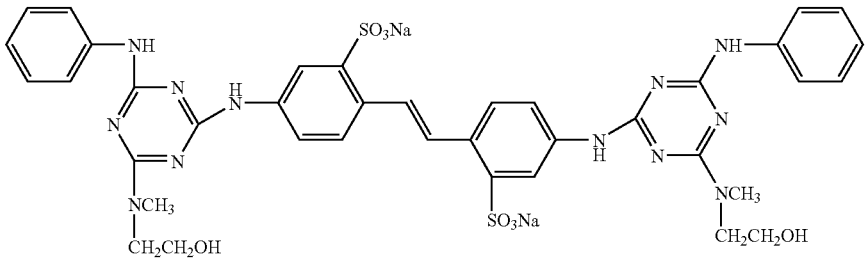

, (2d)

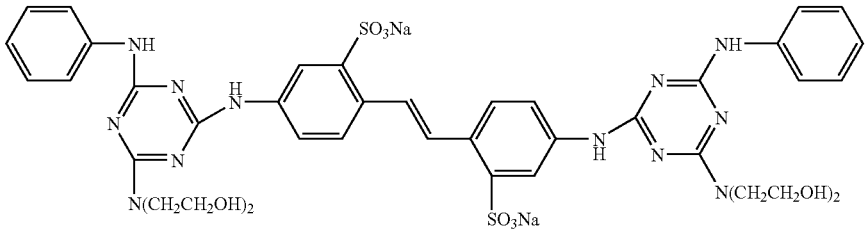

, (2e)

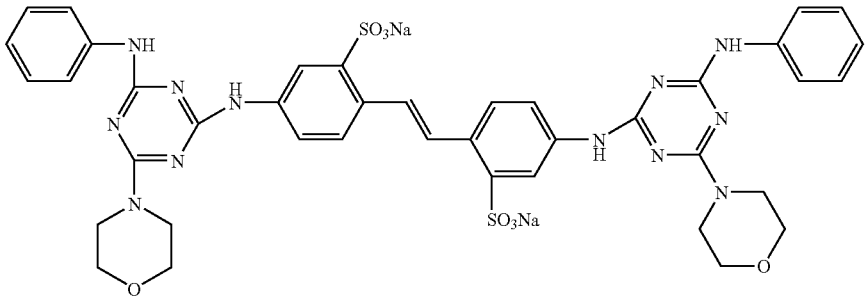

and

-continued (2f)

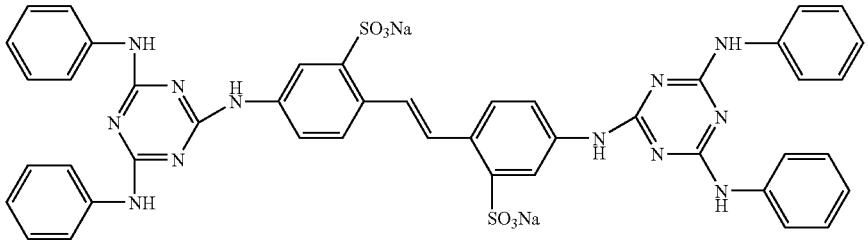

Highly preferred are corresponding detergent compositions D' which contain enzymes as well as peroxide, peroxide activator and/or bleaching catalyst.

Preferred are detergent compositions comprising i) 1-70 wt-% of at least one anionic surfactant and/or a nonionic surfactant;

ii) 0-75 wt-% of at least one builder, iii) 0-30 wt-% of at least one peroxide;

iv) 0-10 wt-% of at least one peroxide activator;

v) 0.001-5 wt-% of a mixture comprising at least one compound of formula (1) and at least one compound of formula (2); and vi) 0.05-5 wt-% of at least one enzyme selected from the group consisting of cellulase, protease, amylase and lipase, especially protease.

Highly preferred are detergent compositions comprising i) 5-70 wt-% of at least one anionic suriactant and/or a nonionic surractant;

ii) 5-70 wt-% of at least one builder;

iii) 0.5-30 wt-% of at least one peroxide;

iv) 0.5-10 wt-% of at least one peroxide activator and/or 0.1-2 wt-% of a bleaching catalyst;

v) 0.01-5 wt-% of a mbdure comprising at least one compound of formula (1) and at least one compound of formula (2); and vi) 0.05-5 wt-% of at least one enzyme selected from the group consisting of cellulase, protease, amylase and lipase, especially protease.

All preferences for the compounds of formula (1) and for the compounds of formula (2) defined above apply also for component v) of the detergent composition.

Very highly preferred are detergent compositions comprising i) 5-70 wt-% of at least one anionic surfactant and/or a nonionlo surfactant;

ii) 5-70 wt-% of at least one builder;

ii) 0.5-30 wt-% of at least one peroxide;

iv) 0.01-10 wt-% of at least one permxide activator and/or 0.1-2 wt-% of a bleaching catalyst;

v) 0.01-5 wt-% of a mike comprising at least one compound of formula (1')

(1')

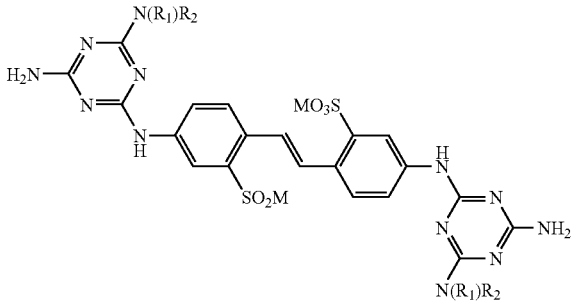

wherein $R_1$ and $R_2$ are hydrogen; unsubstituted or COOH or CN substituted methyl;

$CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and at least one compound of formulae (2b)-(2f)

(2b)

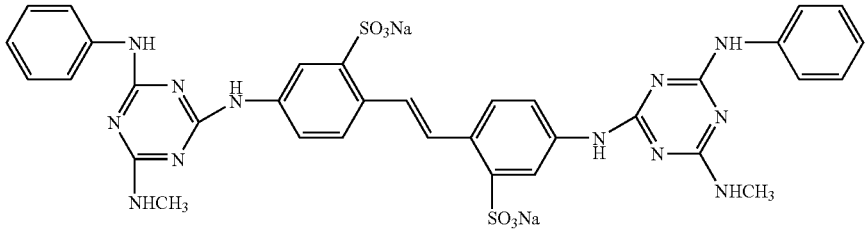

-continued
(2c)
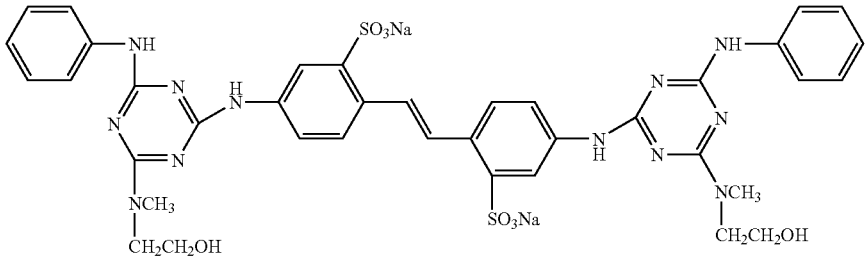
,
(2d)
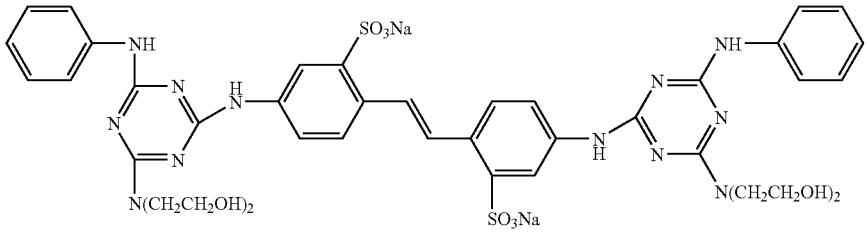
,
(2e)
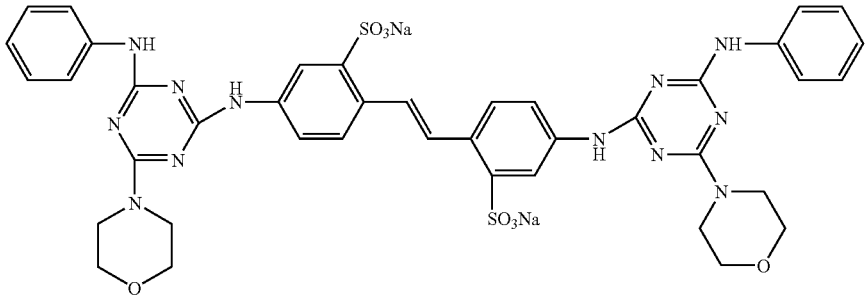
and/or
(2f)
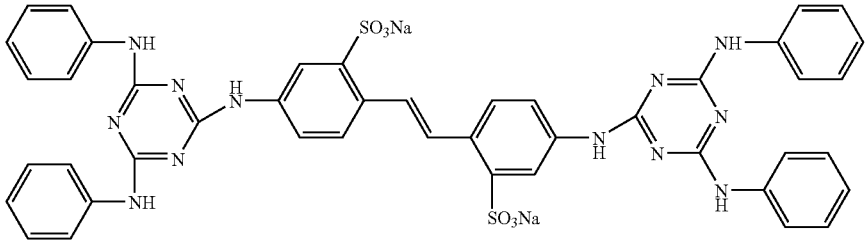
, and vi) 0.05-5 wt-% of at least one enzyme selected from the group consisting of callulase, protease, amylase and lipase, especially protease.

In the mixtures of compounds of formulae (1) or (1') and (2) or (2a) or (2b)-(2f) the molar ratio of compound (1) or (1') to compound (2) or (2a) or (2b)-(2f) is usually in the range of from 0.1:99.9 to 99.9:0.1, preferably from 1:99 to 99:1 and more preferably from 5:95 to 95:5. Highly preferred is a molar ratio of from 10:90 to 90:10, especially 20:80 to 80:20. Most important is a molar ratio of from 30:70 to 70:30, especially 40:60 to 60:40.

As to the enzymes, the detergents and the ingredients thereof the definitions and preferences given above apply.

This detergent treatment of textiles can be conducted as a domestic treatment in normal washing machines.

The textile fibres treated may be natural or synthetic fibres or mixtures thereof. Examples of natural fibres include vegetable fibres such as cotton, viscose, flax, rayon or linen, preferably cotton and animal fibres such as wool, mohair, cashmere, angora and silk, preferably wool. Synthetic fibres include polyester, polyamide and polyacrylonitrile fibres. Preferred textile fibres are cotton, polyamide and wool fibres, especially cotton fibres. Preferably, textile fibres treated according to the method of the present invention have a density of loss than 1000 g/m$^2$, especially less than 500 g/m$^2$ and most preferred lass than 250 g/m$^2$.

According to this process usually an amount of 0.01 to 3.0 wt-%, especially 0.05 to 3.0 wt-%, based on the weight of the textile fibre material, of a mixture comprising at least one compound of formula (1) and at least one compound of formula (2) is used.

The process is usually conducted in the temperature range of from 5 to 100° C., especially 5 to 60° C. Preferred is a temperature range of 5 to 40° C., especially 5 to 35° C. and more preferably 5 to 30° C.

The detergent compositions herein will preferably be formulated such that, during use in aqueous cleaning operations, the wash water will have a pH of between about 6.5 and about 11, preferably between about 7.5 and 11. Laundry products are typically at pH 9-11. Techniques for controlling pH at recommended usage levels include the use of buffers, alkalis, acids, etc., and are well known to those skilled in the art.

Machine laundry methods herein typically comprise treating soiled laundry with an aqueous wash solution in a washing machine having dissolved or dispensed therein an effective amount of a machine laundry detergent composition in accordance with the invention. By an elective amount of the detergent composition it is meant e.g., from 20 g to 300 g of product dissolved or dispersed in a wash solution of volume from 5 to 85 liters, as are typical product dosages and wash solution volumes commonly employed in conventional machine laundry methods. Examples are

- top-loading, vertical axis U.S.-type automatic washing machines using about 45 to 83 liters of water in the wash bath, a wash cycle of about 10 to about 14 minutes and a wash water temperature of about 10 to about 50° C.;
- front-loading, horizontal-axis European-type automatic washing machine using about 8 to 15 liters of water in the wash bath, a wash cycle of about 10 to about 60 minutes and a wash water temperature of about 30 to about 95° C.;
- top-loading, vertical-axis Japanese-type automatic washing machine using about 26 to 52 liters of water in the wash bath, a wash cycle of about 8 to about 15 minutes and a wash water temperature of about 5 to about 25° C.

The liquor ratio is preferably 1:4 to 1:40, especially 1:4 to 1:15. Highly preferred is a liquor ratio of 1:4 to 1:10, especially 1:5 to 1 9.

A further object of the present invention is to provide a process for the domestic washing treatment of a textile fibre material (P) wherein the textile fibre material is contacted with an aqueous solution of a detergent composition comprising a mixture comprising at least one compound of formula (1)

(1)

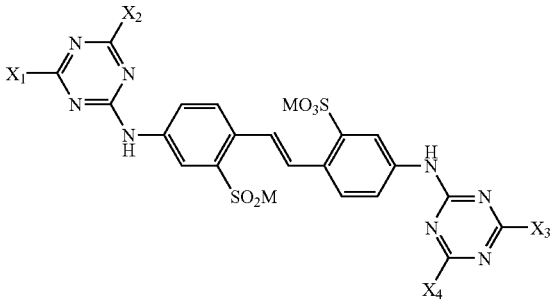

wherein $X_1$, $X_2$, $X_3$ and $X_4$ are, independently of each other, —$N(R_1)R_2$, wherein $R_1$ and $R_2$ are hydrogen; cyano; methyl which is unsubstituted or substituted by hydroxy, cyano, —$CONH_2$ or phenyl; $CH_2CH_2OH$; unsubstituted or $C_1$-$C_4$-alkyl-substituted $C_5$-$C_7$cycloalkyl; or $R_1$ and $R_2$, together with the nitrogen atom linking them, form an unsubstituted or $C_1$-$C_4$alkyl-substituted morpholino, piperidine or pyrrolidine ring; and M is hydrogen or a cation, together with at least one compound of formula (2)

(2)

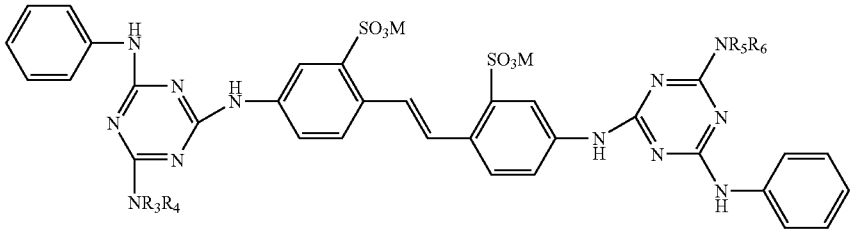

wherein $R_3$ and $R_5$, independently from each other, are hydrogen; unsubstituted $C_1$-$C_8$alkyl or substituted $C_1$-$C_6$alkyl, $R_4$ and $R_6$, independently from each other, are hydrogen; unsubstituted phenyl; unsubstituted $C_1$-$C_8$alkyl or substituted $C_1$-$C_8$alkyl, or $NR_3R_4$ and/or $NR_5R_6$ form an unsubstituted or substituted morpholino ring, and M is hydrogen or a cation, and wherein the detergent composition contains at least one enzyme selected from the group consisting of cellulase, protease, amylase and lipase, and wherein the temperature of the solution is between 5° C. and 40° C., preferably between 5° C. and 30° C., throughout the process.

As to the compounds of formula (1) and (2) as well as to the substituents thereof the meanings and preferences given above apply.

Of interest is a process (P) using a detergent composition comprising at least one compound of formula (1), wherein $X_1$, $X_2$, $X_3$ and $X_4$ are, independently of each other, —$N(R_1)R_2$, wherein $R_1$ and $R_2$ are hydrogen; unsubstituted or CN or COOH-substituted $C_1$-$C_8$alkyl;

$CH_2CH_2OH$; unsubstituted or $C_1$-$C_4$alkyl-substituted $C_5$-$C_7$cycloalkyl, or $R_1$ and $R_2$, together with the nitrogen atom linking them, form an unsubstituted or $C_1$-$C_4$alkyl-substituted morpholino, piperidine or pyrrolidine ring.

Of interest is a process (P) using a detergent composition comprising at least one compound of formula (2), wherein $R_3$ and $R_5$, independently of each other, are hydrogen; unsubstituted $C_1$-$C_4$alkyl or substituted $C_1$-$C_4$alkyl, $NR_4$ and $R_8$, independently of each other, are unsubstituted phenyl; unsubstituted $C_1$-$C_4$alkyl or substituted $C_1$-$C_4$alkyl, or $NR_3R_4$ and/or $NR_5R_8$ form a morpholino ring, and M is hydrogen or a cation.

Of preferred interest is a process (P) using a detergent composition comprising at least one compound of formula (2), wherein $R_3$ and $R_5$, independently of each other, are hydrogen; unsubstituted $C_1$-$C_2$alkyl or $C_1$-$C_4$alkyl, which is substituted by hydroxy or $C_1$-$C_4$alkoxy, $R_4$ and $R_8$, independently of each other, are unsubstituted phenyl; unsubstituted $C_1$-$C_2$alkyl or $C_1$-$C_4$alkyl, which is substituted by hydroxy or $C_1$-$C_4$alkoxy, or $NR_3R_4$ and/or $NR_5R_6$ form a morpholino ring, and M is hydrogen or a cation.

Of more preferred interest is a process (P) using a detergent composition comprising at least one compound of formula (2a)

(2a)

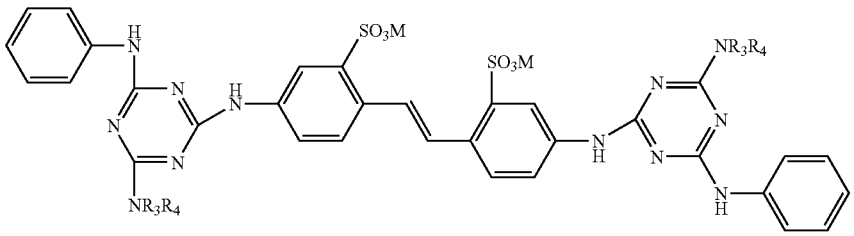

$R_1$ and $R_2$, together with the nitrogen atom linking them, form an unsubstituted or $C_1$-$C_4$alkyl-substituted morpholino, piperidine or pyrrolidine ring, and M is hydrogen or a cation.

Of particular interest is a process (P) using a detergent composition comprising at least one compound of formula formula (1), wherein $X_1$ and $X_3$ are amino, and $X_2$ and $X_4$ are a radical of formula —$N(R_1)R_2$, wherein $R_1$ and $R_2$ are hydrogen; unsubstituted or COOH or CN substituted methyl;

$CH_2CH_2OH$; unsubstituted or $C_1$-$C_4$alkyl-substituted cyclopentyl or cyolohexyl, or wherein $R_3$ is hydrogen; unsubstituted $C_1C_2$alkyl or $C_1$-$C_4$alkyl, which is substituted by hydroxy or $C_1$-$C_4$alkoxy.

$R_4$ is unsubstituted phenyl; unsubstituted $C_1$-$C_2$alkyl or $C_1$-$C_4$alkyl, which is substituted by hydroxy or $C_1$-$C_4$alkoxy, or $NR_3R_4$ forms an unsubstituted or substituted morpholino ring, and M is hydrogen or an alkali metal atom, preferably sodium.

Of special interest is a process (P) using a detergent composition comprising at least one compound of formulae (2b)-(2f)

(2b)
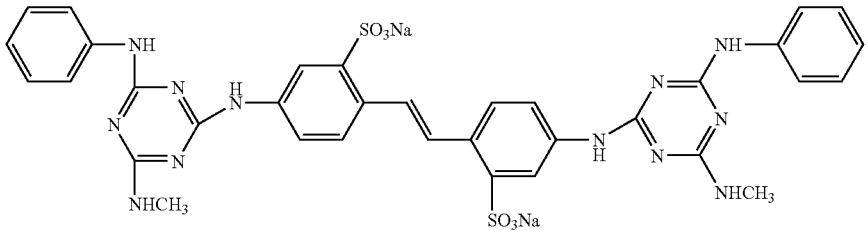
,
(2c)
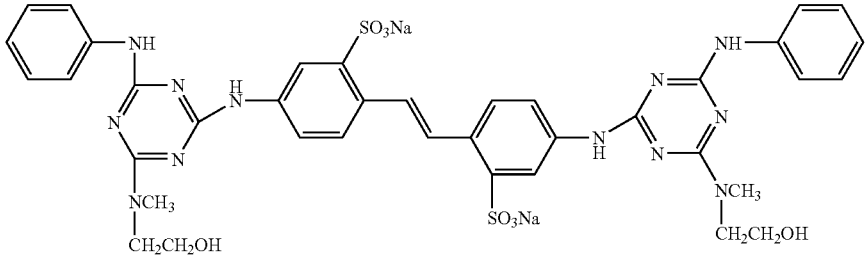
,
(2d)
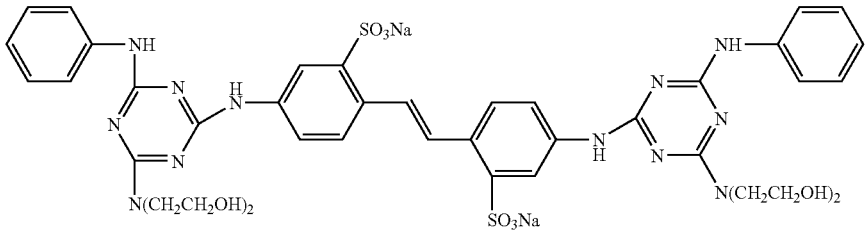
,
(2e)
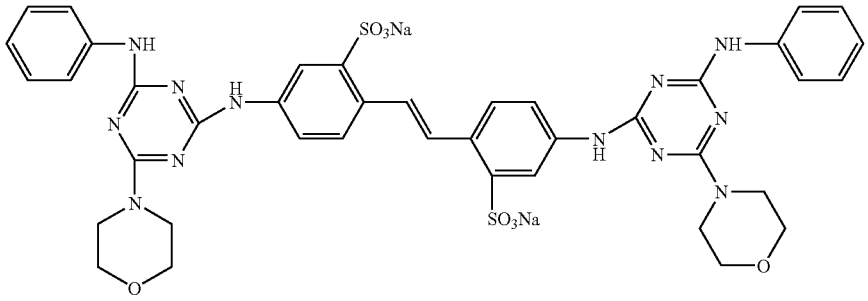
and/or
(2f)
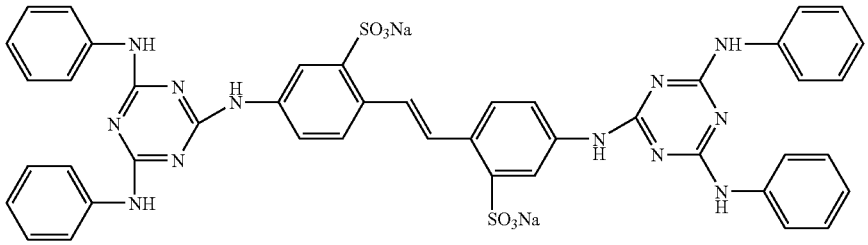
.

An especially perferred process for the domestic washing treatment of a textile fibre material (P) wherein the textile fibre material is contacted with an aqueous solution of a detergent composition comprising a mixture comprising at least one compound of formula (1')

(1')

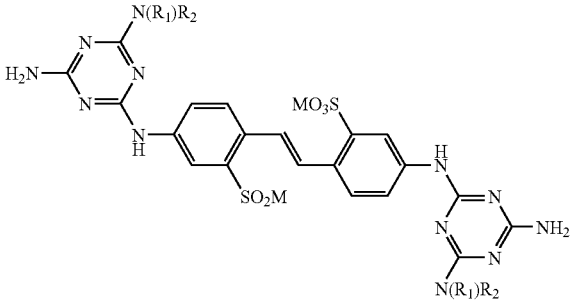

wherein $R_1$ and $R_2$ independently from each other are hydrogen; unsubstituted or COOH or CN substituted methyl; CH2CH$_2$OH; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and at least one compound of formulae (2b)-(2f)

(2b)

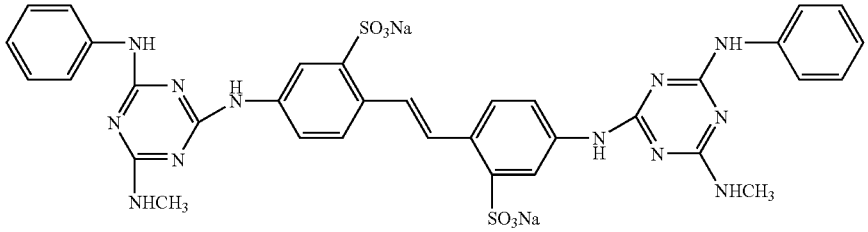

, (2c)

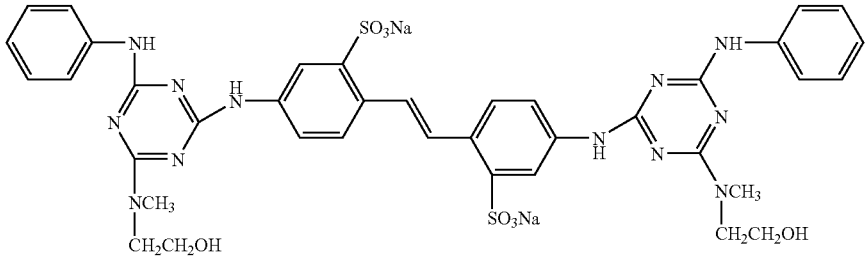

, (2d)

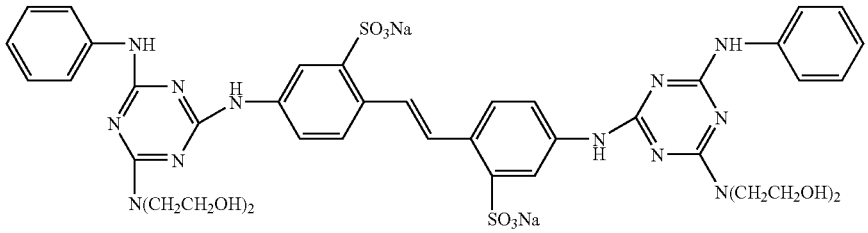

, (2e)

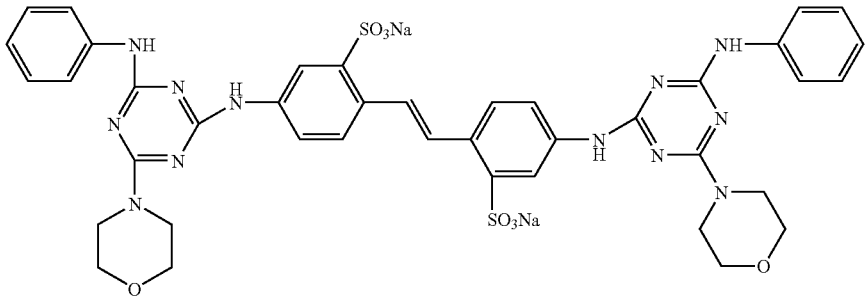

and/or

-continued (2f)

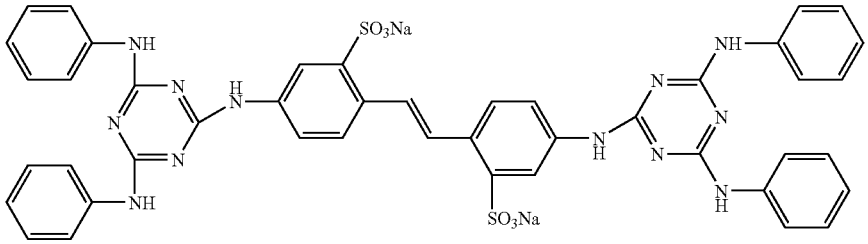

and wherein the detergent composition contains at least one enzyme selected from the group consisting of cellulase, protease, amylase and lipase, and wherein the temperature of the solution is between 5° C. and 40° C., preferably between 50C and 30° C., throughout the process.

According to this process usually an amount of 0.01 to 3.0 wt-%, especially 0.05 to 3.0 wt-%, based on the weight of the textile fibre material, of the mixture comprising at least one compound of formula (1) or (1') and at least one compound of formula (2), (2a) or (2b)-(2f) is used.

In the mixtures of compounds of formulae (1) or (1') and (2) or (2a) or (2b)-(2f) the molar ratio of compound (1) or (1') to compound (2) or (2a) or (2b)-(2f) is usually in the range of from 0.1:99.9 to 99.9:0.1, preferably from 1:99 to 99:1 and more preferably from 5:95 to 95:5.

Highly preferred is a molar ratio of from 10:90 to 90:10, especially 20:80 to 80:20. Most important is a molar ratio of from 30:70 to 70:30, especially 40:60 to 60:40.

The mixtures used according to the present invention are particularly advantageous in that they exhibit not only extremely high whitening ability, but, in addition, in many cases highly desirable water solubilities and also possess excellent white aspects in the solid state. A further advantage of the present invention is that the detergent composition delivers improved whiteness performance and fabric feel. Furthermore the mixtures show very good results with respect to exhaustion properties.

A further embodiment of the present invention are mixtures M comprising at least one compound of formula (1)

(1)

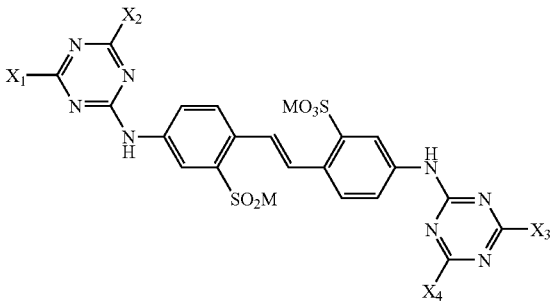

wherein $X_1$, $X_2$, $X_3$, and $X_4$ are, independently of each other, —$N(R_1)R_2$, wherein $R_1$ and $R_2$ are hydrogen;, cyano; unsubstituted or substituted methyl,; $CH_2CH_2OH$ or $C_5$-$C_7$cycloalkyl, or $R_1$ mind $R_2$, together with the nitrogen atom linking them, form a heterocyclic ring, and M is hydrogen or a cation.

together with at least one compound of formula (2)

(2)

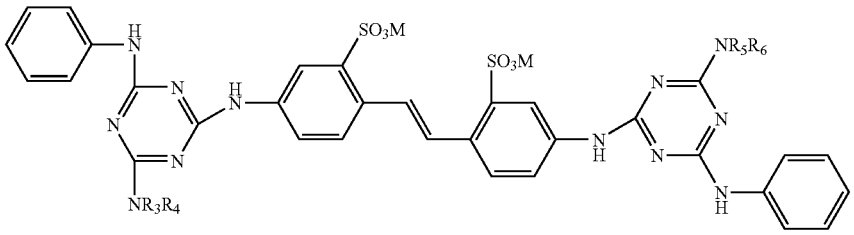

wherein $R_3$ and $R_5$ independently from each other, are hydrogen; unsubstituted $C_1$-$C_8$alkyl or substituted $C_1$-$C_8$alkyl, $R_4$ and $R_8$ independently from each other, are hydrogen, unsubstituted phyenyl;

unsubstituted $C_1$-$C_8$alkyl or substituted $C_1$-$C_8$alkyl, or $NR_3R_4$ and/or $NR_5R_6$ from an unsubstituted or substituted morpholino ring, and M is hydrogen or a cation.

Of interest are mixtures M comprising at least one compound of formula (1), wherein $R_1$ and $R_2$ are independently from each other hydrogen; cyano; methyl which is unsubstituted or substituted by hydroxy, cyano, —$CONH_2$, —COOH or phenyl;

$CH_2CH_2OH$; unsubstituted or $C_1$-$C_4$alkyl-substituted $C_5$-$C_7$cycloalkyl; or $R_1$ and $R_2$, together with the nitrogen atom linking them, form an unsubstituted or $C_1$-$C_4$alkyl-substituted morpholino, piperidine or pyrrolidine ring.

Of particular interest are mixtures M comprising at least one compound of formula (1), wherein $X_1$ and $X_3$ are amino, and $X_2$ and $X_4$ are a radical of formula —$N(R_1)R_2$, Of interest are mixtures M comprising at least one compound of formula (2), wherein $R_3$ and $R_5$, independently of each other, are hydrogen; unsubstituted $C_1$-$C_4$alkyl or substituted $C_1$-$C_4$alkyl, $R_4$ and $R_8$, independently of each other, are unsubstituted phenyl; unsubstituted $C_1$-$C_4$alkyl or substituted $C_1$-$C_4$alkyl, or $NR_3R_4$ and/or $NR_5R_6$ form an unsubstituted or substituted morpholino ring, and M is hydrogen or a cation.

Of preferred interest are mixtures M comprising at least one compound of formula (2), wherein $R_3$ and $R_5$, independently of each other, are hydrogen; unsubstituted $C_1$-$C_2$alkyl or $C_1$-$C_4$alkyl, which is substituted by hydroxy or $C_1$-$C_4$alkoxy, $R_4$ and $R_8$, independently of each other, are unsubstituted phenyl; unsubstituted $C_1$-$C_2$alkyl or $C_1$-$C_4$alkyl, which is substituted by hydroxy or $C_1$-$C_4$alkoxy, or $NR_3R_4$ and/or $NR_5R_6$ form an unsubstituted or substituted morpholino ring, and M is hydrogen or a cation.

Of more preferred interest are mixtures M comprising at least one compound of formula (2a)

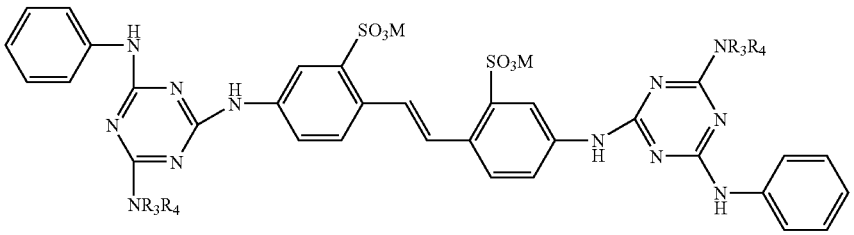

(2a)

wherein $R_1$ and $R_2$ are independently from each other hydrogen; unsubstituted or COOH or CN substituted methyl; $CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrolidine ring.

Most interesting are mixtures M comprising at least one compound of formula (1), wherein $R_1$ and $R_2$, together with the nitrogen atom linking them, form an unsubstituted or $C_1$-$_4$alkyl-substituted morpholino, piperidine or pyrrolidine ring.

wherein $R_3$ is hydrogen, unsubstituted $C_1$-$C_2$alkyl or $C_1$-$C_4$alkyl, which is substituted by hydroxy or $C_1$-$C_4$alkoxy, $R_4$ is unsubstituted phenyl; unsubstituted $C_1$-$C_2$alkyl or $C_1$-$C_4$alkyl, which is substituted by hydroxy or $C_1$-$C_4$alkoxy, or $NR_3R_4$ forms an unsubstituted or substituted morpholino ring, and M is hydrogen or an alkali metal atom, preferably sodium.

Of special interest am mixtures M comprising compounds of formula (2), wherein the compounds of formula (2) are those of formula (2b)-(2f)

(2b)
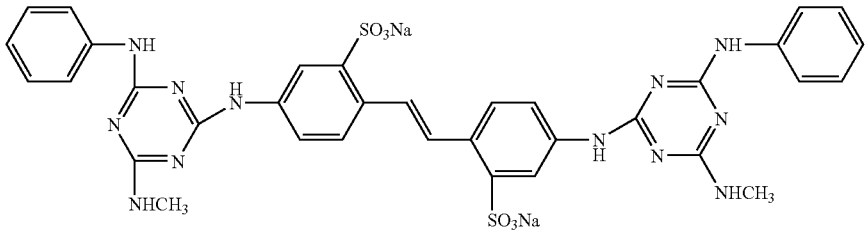
,
(2c)
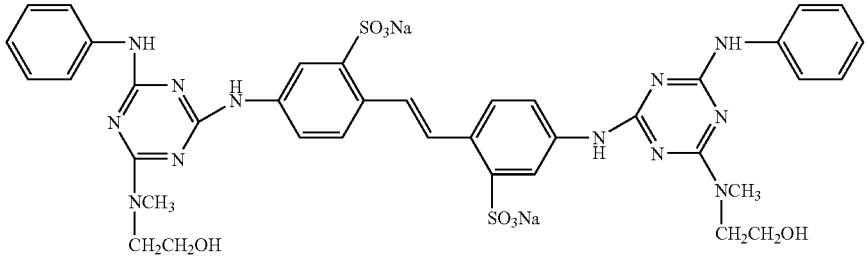
,
(2d)
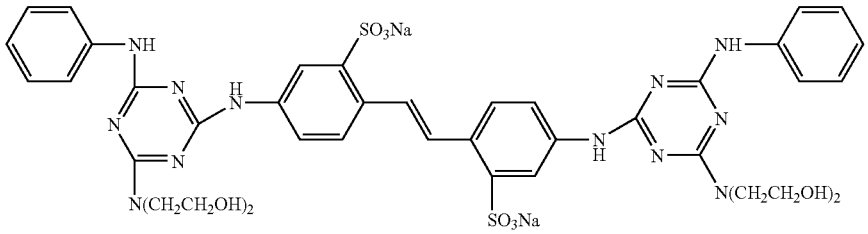
,
(2e)
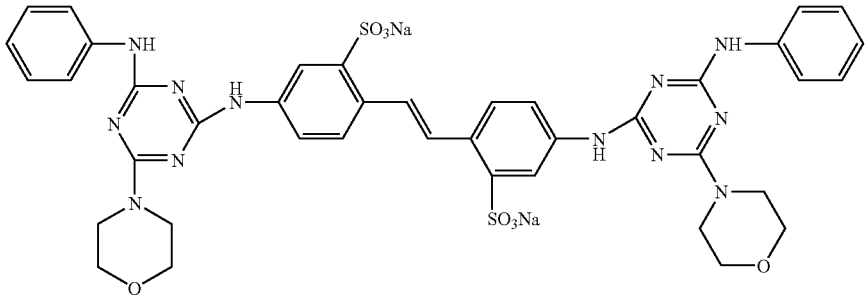
and/or
(2f)
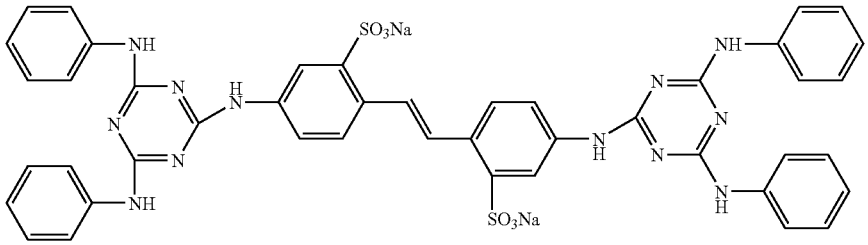
.

Especially preferred mixtures M are those comprising at least one compound of formula (1')

(1')

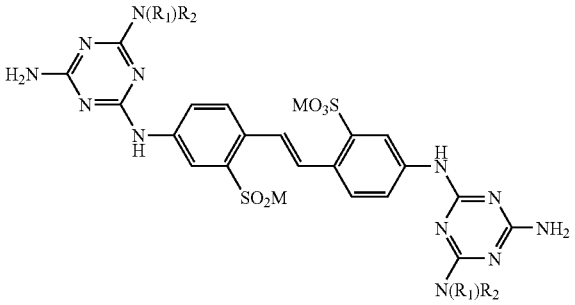

wherein $R_1$ and $R_2$ independently from each other are hydrogen; unsubstituted or COOH or CN substituted methyl; $CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morphorlino, piperidine or pyrrolidine ring, and at least one compound of formulae (2b)-(2f)

(2b)

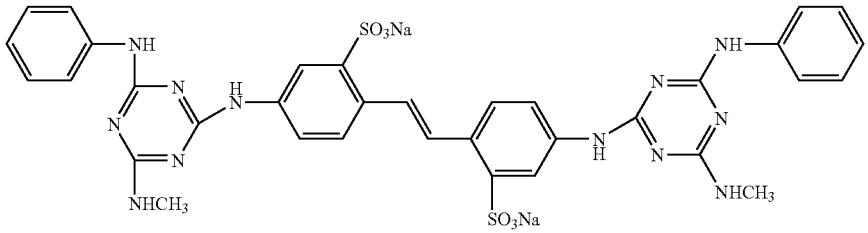

, (2c)

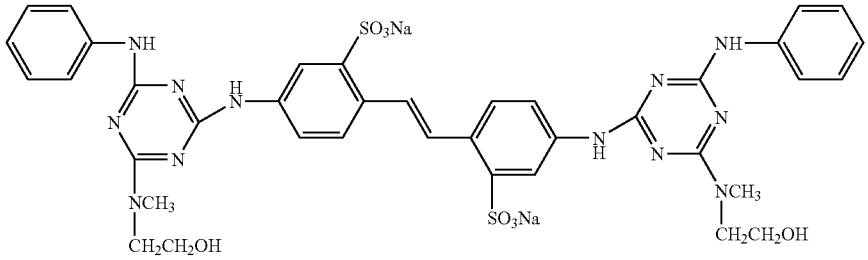

, (2d)

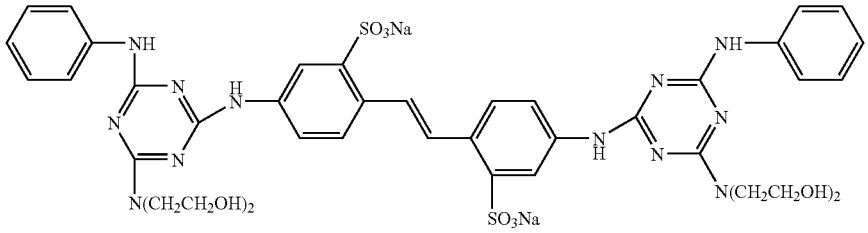

, (2e)

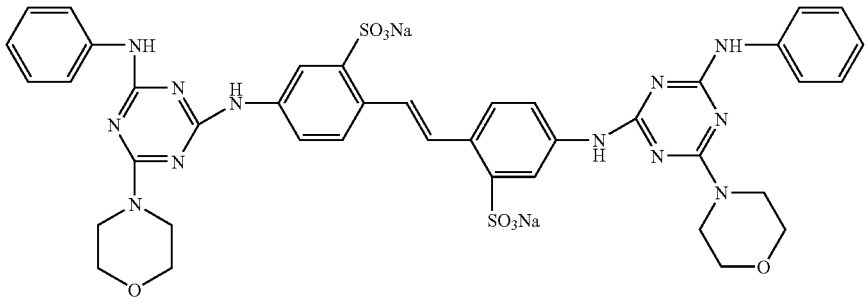

and/or

-continued (2f)

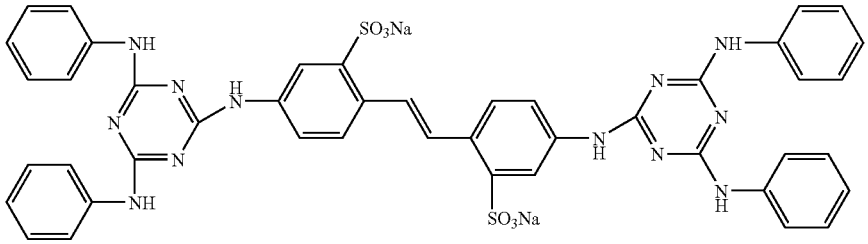

In the mixture of compounds of formulae (1) or (1') and (2) or (2a) or (2b)-(2f) the molar ratio of compound (1) or (1') to compound (2) or (2a) or (2b)-(2f) is usually in the range of from 0.1:99.9 to 99.9:0.1, preferably from 1:99 to 99:1 and more preferably from 5:95 to 95:5. Highly preferred is a molar ratio of from 10:90 to 90:10. especially 20:80 to 80:20. Most important is a molar ratio of from 30:70 to 70:30, especially 40:60 to 60:40.

The compounds have the advantage that they are also effective in the presence of active chlorine donors such as, for example, hypochlorite and can be used without substantial lose of the effects in washing baths with non-ionic washing agents, for example alkylphenol polyglycol ethers. Also in the presence of perborate or peracids and activations, for example tetraacetylglycoluril or ethylenediamine-tetraacetic acid are the mixtures of these compounds stable both in pulverulent washing agent and in washing baths. In addition, they impart a brilliant appearance in daylight.

The following Examples serve to illustrate the invention; parts and percentages are by weight and the temperature is given in degree Celsius unless otherwise stated.

PREPARATION EXAMPLE 1

In a 1 liter flask 0.05 mole of the compound of formula (102)

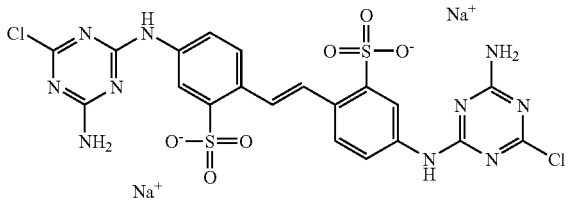

(52205-59-1)

(101)

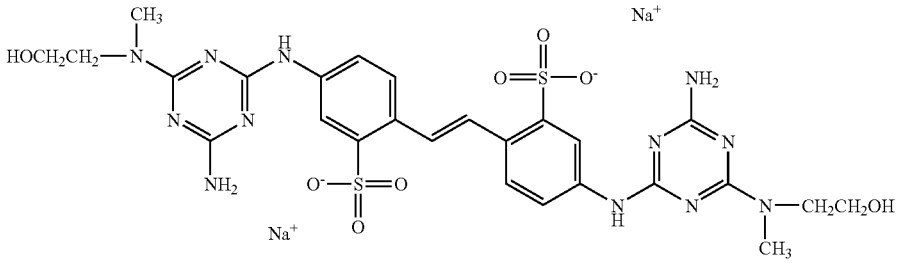

are mixed with 600 ml of water and heated to a temperature of 60° C. Then 7.8 g of methylethanotamine are added and the reaction mixture is heated to a temperature of 98° C.; during heating the pH is maintained at a value between 8.5 and 9 by addition of a 4-molar aqueous solution of sodium hydroxide. The reaction mixture is cooled to 30° C. The precipitate is filtered off, washed with 100 ml of a 10% aqueous sodium chloride solution and dried in vacuum. In this way, there are obtained 29.3 g of a yellowish product of the compound of formula,(101).

PREPARATION EXAMPLES 2 to 12

The following compounds of formula

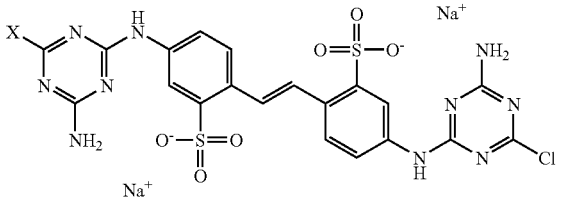

can be prepared in analogy to the process given in Preparation Example 1, by replacing methylethanolamine with an equimolar amount of the corresponding amine. X is as defined in the following Table 1. Compounds which precipitate after cooling to 50° C. are isolated directly as sodium salts without addition of hydrochloric acid and then dried in vaccuum.

TABLE 1

| Example | X |
|---|---|
| 2 | 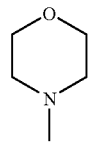 |
| 3 | 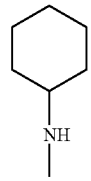 |
| 4 | —$NHCH_2COOH$ |
| 5 | —$NHCH_2CH_2OH$ |
| 6 | —$NHCH_2CH_2COOH$ |
| 7 | —$N(CH_3)CH_2COOH$ |
| 8 | —$N(CH_2CH_2OH)_2$ |
| 9 | 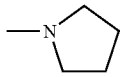 |
| 10 | 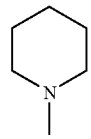 |

PREPARATION EXAMPLE 11

(103)

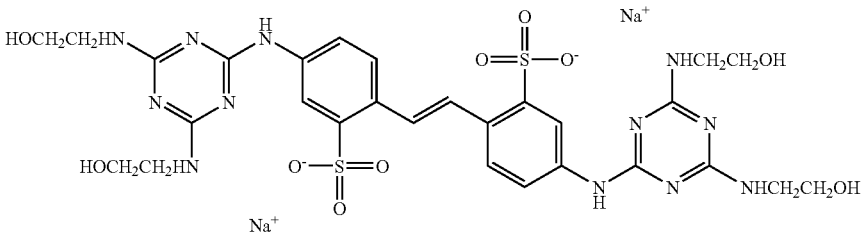

In a 2 liter flask 130 ml of methylethylketone, 80 ml of deionised water, 150 g of ice and 18.5 g cyanuric chloride are mixed. Over a period of 30 minutes 185 ml of a solution of 4,4'-diaminostilbene-2,2'-disulfonic acid (as disodium salt) in water (concentration of 100 g/l ) are added dropwise, the temperature being between −8 and +5° C. The pH is maintained at a value between 4.5 and 5 by addition of an aqueous sodium carbonate solution. A yellowish suspension is obtained. Then, by use of a dropping funnel, 27.2 g of ethanolamine (99%) are added. The pH increases to a value of 10 and then drops to a lower value, whereby the temperature increases to 10 to 15° C. Then the reaction mixture is warmed to a temperature of 45° C. and held at this temperature for 20 minutes. During heating to 98° C. within 30 minutes a mixture of methylethylketone and water is distilled off; the pH is maintained at a value between 8.5 and 9 by addition of an aqueous sodium hydroxide solution. After no further addition of aqueous sodium hydroxide solution is necessary in order to maintain the pH at a constant value the reaction mixture is cooled to 50° C.

A yellowish crystalline precipitate can be filtered off. After drying 29 g of a yellowish product of the compound of formula (103) are obtained.

PREPARATION EXAMPLE 12

(104)

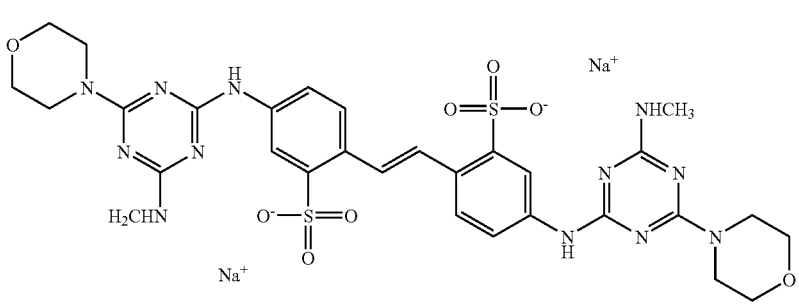

In a 1 liter pressure vessel 0.037 mole of N,N'-bis-morpholino-6-chloro-1,3,5-triazine-2-yl)-4,4-diaminostilbene-2,2'-disulfonic acid (as disodium salt) are suspended in 500 ml of water. 18 g of an aqueous solution of methylamine (40%) are added and the reaction mixture is heated to a temperature of 100 to 105° C. and stirred for4.5 hours. The reaction mixture is cooled to 25° C. and the precipitate is filtered off, washed with 100 ml of a 10% aqueous sodium chloride solution and dried in vacuum at 70° C. In this way there are obtained 21.2 g of a yellowish powder of the compound of formula (104) are obtained.

PREPARATION EXAMPLE 13

(104a)

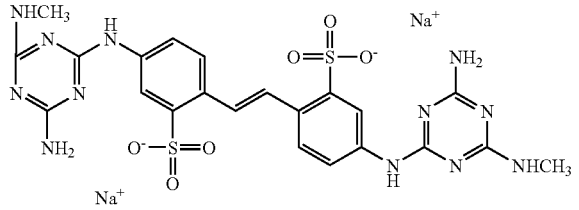

The compound of formula (104a) can be prepared in analogy to the process given in Preparation Example 12, by replacing N,N'-bis-4-morpholino-6-chloro-1,3,5-triazine-2-yl)-4,4'-diaminostilbene-2,2'-disulfonic acid with an equimolar amount of the compound of formula (101).

PREPARATION EXAMPLE 14

(104b)

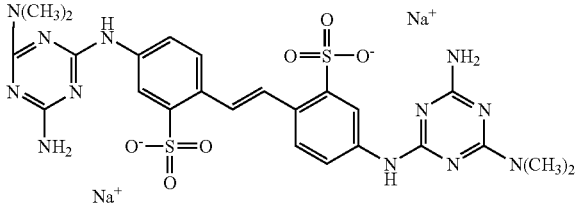

The compound of formula (104b) can be prepared in analogy to the process given in Preparation Example 13, by methylamine with an equimolar amount of dimethylamine.

PREPARATION EXAMPLE 15

(105)

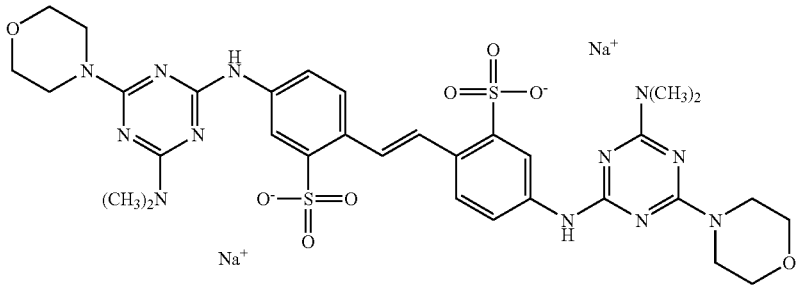

The compound of formula (105) can be prepared in analogy to the process given in Preparation Example 14, by replacing 18 g of an aqueous solution of methylamine (40%) with a corresponding solution containing an equimolar amount of dimethylamine.

PREPARATION EXAMPLE 16

(106)

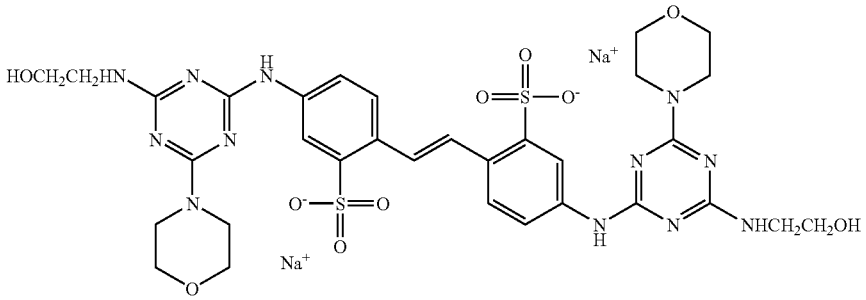

In a 1 liter flask 0.05 mole of N,N'-bis-(4-morpholino-6-chloro-1,3,5-triazine-2-yl)-4,4'-diaminostilbene-2,2-disulfonic acid (as disodium salt) are suspended in 600 ml of water and heated to a temperature of 60° C. 6.4 g of ethanolamine are added and the reaction mixture is heated to a temperature of 98° C. The pH is maintained at a value between 8.5 and 9 by addition of a 4-molar aqueous sodium hydroxide solution. The reaction mixture is cooled to 25° C. and 10% by volume of sodium chloride are added. The precipitate is filtered off, washed with 100 ml of a 10% aqueous sodium chloride solution and dried in vacuum at 70° C. In this way there are obtained 41.8 g of a yellowish powder.

APPLICATION EXAMPLE 1

General Procedure:

A wash liquor is prepared by dissolving 0.8 g of a washing powder in 200 ml of tap water. 10 g of bleached cotton fabric is added to the bath and washed at 40° C. over 15 minutes and then rinsed, spindried and ironed at 160° C.

The following washing powders A and B are used (amounts given in the following Tables 2a and 2b are in g):

TABLE 2a (Ingredients of washing powders A and B)

| Ingredients | A | B |
|---|---|---|
| Sodium laurylbenzene-sulfonate (LAS) | 10 g | 10 g |
| Sodium lauryl ether sulfate (AES) | 3 g | 3 g |
| Dobanol 23-6.5 (nonionic alcoholethoxylate) | 4 g | 4 g |
| Sodium tripolyphosphate | 30 g | — |

TABLE 2a-continued (Ingredients of washing powders A and B)

| Ingredients | A | B |
|---|---|---|
| Zeolite A | — | 20 g |
| Sodium carbonate | 15 g | 15 g |
| Sodium silicate | 5 g | 5 g |
| Sodium sulfate | 11 g | 17 g |
| Sodium perborate monohydrate | 10 g | 10 g |
| TAED | 3 g | 3 g |
| Polycarboxytate (co-builder) | — | 4 g |
| Carboxymethylcellulose | 2 g | 2 g |
| Perfume | 0.1 g | 0.1 g |
| Water | 5 g | 5 g |
| Fluorescent whitener used | X g | X g |

TABLE 2b (Washing powders used)

| | Amount of fluorescent whitenor | Washing powder |
|---|---|---|
| Mixture of compound of Prep. Ex. 6 and compound of formula (2b) [7:3 weight ratio] | 0.2 g | A |
| Mixture of compound of Prep. Ex. 12 and compound of formula (2b) [7:3 weight ratio] | 0.1 g | B |
| Mixture of compound of Prep. Ex. 14 and compound of formula (2c) [7:3 weight ratio] | 0.3 g | A |
| Mixture of compound of Prep. Ex. 1 and compound of formula (2c) [1:1 weight ratio] | 0.2 g | A |
| Mixture of compound of Prep. Ex. 2 and compound of formula (2d) [1:2 weight ratio] | 0.4 g | A |
| Mixture of compound of Prep. Ex. 3 and compound of formula (2d) [1:5 weight ratio] | 0.15 g | B |
| Mixture of compound of Prep. Ex. 4 and compound of formula (2e) [5:1 weight ratio] | 0.1 g | B |
| Mixture of compound of Prep. Ex. 5 and compound of formula (2e) [1:1 weight ratio] | 0.3 g | B |
| Mixture of compound of Prep. Ex. 6 and compound of formula (2f) [3:7 weight ratio] | 0.2 g | A |
| Mixture of compound of Prep. Ex. 7 and compound of formula (2f) [1:9 weight ratio] | 0.3 g | A |
| Mixture of compound of Prep. Ex. 8 and compound of formula (2f) [9:1 weight ratio] | 0.2 g | B |
| Mixture of compound of Prep. Ex. 9 and compound of formula (2b) [1:1 weight ratio] | 0.1 g | A |
| Mixture of compound of formula (107) and compound of formula (2b) [1:1 weight ratio] | 0.3 g | B |

Constitution of compound of formula (107):

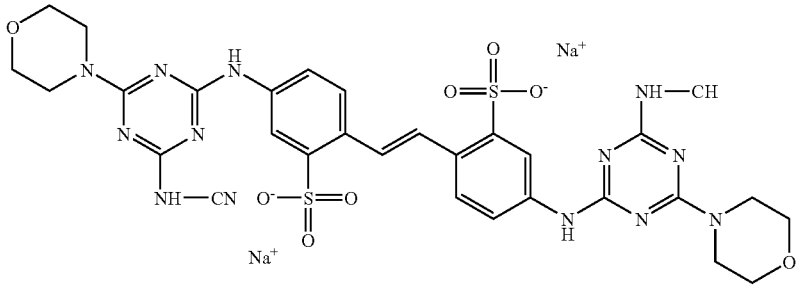

(107)

The cotton fabrics washed with the detergents given in Table 2b according to the general procedure show good whiteness properties.

APPLICATION EXAMPLE 2

General Procedure:

A wash liquor is prepared by dissolving 0.8 g of a washing powder in 200 ml of tap water. 10 g of bleached cotton fabric is added to the bath and washed at 30° C. over 15 minutes and then rinsed, spin-dried and ironed at 160° C.

The following washing powders are used (amounts given in the following Tables 3a and 3b are percent by weight, based on the total weight of the detergent):

TABLE 3a

Ingredients of washing powders C and D)

| Ingredients | C | D |
|---|---|---|
| Sodium laurylbanzene-sulfonate (LAS) | 8% | 8% |
| Sodium lauryl ether sulfate (AES) | 3% | 3% |
| Dobanol 23-6.5 (non-ionic alcoholethoxylate) | 5% | 5% |
| Zeolite A | 20% | 20% |
| Polycarboxylate (co-builder) | 5% | 5% |
| Soda ash | 18% | 18% |
| Sodium silicate | 4% | 4% |
| Sodium sulfate | 5% | 5% |
| Hydroxyethanediphosphonic acid (complexing agent) | 0.5% | 0.5% |
| Cellulase | 1.5% | — |
| Protease | — | 1.5% |
| Carboxymethylcellulose | 1% | 1% |
| Sodium perborate monohydrate | 15% | 15% |
| TAED | 5% | 5% |
| Soap | 2% | 2% |
| Fluorescent whitener used | X% | X% |

In each of the above detergents a sufficient amount of water is used to give 100%.

TABLE 3b (Washing powders used)

| | Amount of fluorescent whitener | Washing powder |
|---|---|---|
| Mixture of compound of Prep. Ex. 13 and compound of formula (2b) [7:3 weight ratio] | 0.2% | C |

TABLE 3b-continued (Washing powders used)

| | Amount of fluorescent whitener | Washing powder |
|---|---|---|
| Mixture of compound of Prep. Ex. 10 and compound of formula (2b) [7:3 weight ratio] | 0.2% | C |
| Mixture of compound of Prep. Ex. 11 and compound of formula (2c) [7:3 weight ratio] | 0.3% | C |
| Mixture of compound of Prep. Ex. 1 and compound of formula (2c) [1:1 weight ratio] | 0.2% | D |
| Mixture of compound of Prep. Ex. 14 and compound of formula (2d) [1:2 weight ratio] | 0.2% | C |
| Mixture of compound of Prep. Ex. 2 and compound of formula (2d) [1:5 weight ratio] | 0.4% | C |
| Mixture of compound of Prep. Ex. 3 and compound of formula (2e) [5:1 weight ratio] | 0.3% | D |
| Mixture of compound of Prep. Ex. 4 and compound of formula (2e) [1:1 weight ratio] | 0.2% | C |
| Mixture of compound of Prep. Ex. 13 and compound of formula (2f) [3:7 weight ratio] | 0.3% | D |
| Mixture of compound of Prep. Ex. 5 and compound of formula (2f) [1:9 weight ratio] | 0.3% | C |
| Mixture of compound of Prep. Ex. 6 and compound of formula (2f) [9:1 weight ratio] | 0.4% | C |
| Mixture of compound of Prep. Ex. 7 and compound of formula (2b) [1:1 weight ratio] | 0.3% | C |
| Mixture of compound of formula (107) and compound of formula (2c) [1:1 weight ratio] | 0.5% | C |
| Mixture of compound of formula (107) and compound of formula (2d) [1:1 weight ratio] | 0.3% | D |

As to the constitution of compound of formula (109) see Application Example 1.

The cotton fabrics washed with the detergents given in Table 3b according to the general procedure show good whiteness properties.

APPLICATION EXAMPLE 3

General Procedure:

A wash liquor is prepared by dissolving 0.8 g of a washing powder in 200 ml of tap water. 10 g of bleached cotton fabric is added to the bath and washed at 40° C. over 15 minutes and then rinsed, spin-dried and ironed at 160° C.

The following washing powders A and B are used (amounts given in the following Tables 4a and 4b are in g):

TABLE 4a (Ingredients of washing powders A and B)

| Ingredients | A | B |
|---|---|---|
| Sodium laurylbenzene-sulfonate (LAS) | 10 g | 10 g |
| Sodium lauryl ether sulfate (AES) | 3 g | 3 g |
| Dobanol 23-6.5 (nonionic alcoholethoxylate) | 4 g | 4 g |
| Sodium tripolyphosphate | 30 g | — |
| Zeolite A | — | 20 g |
| Sodium carbonate | 15 g | 15 g |
| Sodium silicate | 5 g | 5 g |
| Sodium sulfate | 11 g | 17 g |
| Cellulase | 1.5 g | — |
| Protease | — | 1.5 g |

TABLE 4a-continued (Ingredients of washing powders A and B)

| Ingredients | A | B |
|---|---|---|
| Polycarboxylate (co-builder) | — | 4 g |
| Carboxymethylcellulose | 2 g | 2 g |
| Perfume | 0.1 g | 0.1 g |
| Water | 5 g | 5 g |
| Fluorescent whitener or mixture of fluorescent whitener used | X g | X g |

TABLE 4b (Washing powders used)

| | Amount of fluorescent whitener | Washing powder |
|---|---|---|
| Mixture of compound of Prep. Ex. 13 and compound of formula (2b) [7:3 weight ratio] | 0.2 g | A |
| Mixture of compound of Prep. Ex. 10 and compound of formula (2b) [7:3 weight ratio] | 0.1 g | B |
| Mixture of compound of Prep. Ex. 11 and compound of formula (2c) [7:3 weight ratio] | 0.3 g | A |
| Mixture of compound of Prep. Ex. 1 and compound of formula (2c) [1:1 weight ratio] | 0.2 g | A |
| Mixture of compound of Prep. Ex. 14 and compound of formula (2d) [1:2 weight ratio] | 0.4 g | A |
| Mixture of compound of Prep. Ex. 2 and compound of formula (2d) [1:5 weight ratio] | 0.15 g | B |
| Mixture of compound of Prep. Ex. 3 and compound of formula (2e) [5:1 weight ratio] | 0.1 g | B |
| Mixture of compound of Prep. Ex. 4 and compound of formula (2e) [1:1 weight ratio] | 0.3 g | B |
| Mixture of compound of Prep. Ex. 13 and compound of formula (2f) [3:7 weight ratio] | 0.2 g | A |
| Mixture of compound of Prep. Ex. 5 and compound of formula (2f) [1:9 weight ratio] | 0.4 g | B |
| Mixture of compound of Prep. Ex. 6 and compound of formula (2f) [9:1 weight ratio] | 0.3 g | A |
| Mixture of compound of Prep. Ex. 7 and compound of formula (2b) [1:1 weight ratio] | 0.2 g | B |
| Mixture of compound of formula (107) and compound of formula (2b) [1:1 weight ratio] | 0.5 g | B |
| Mixture of compound of formula (107) and compound of formula (2c) [1:1 weight ratio] | 0.3 g | B |
| Mixture of compound of formula (107) and compound of formula (2d) [1:1 weight ratio] | 0.2 g | B |
| Mixture of compound of Prep. Ex. 2 and compound of formula (2b) [1:1 weight ratio] | 0.2 g | B |
| Mixture of compound of Prep. Ex. 13 and compound of formula (2c) [1:1 weight ratio] | 0.1 g | A |
| Mixture of compound of Prep. Ex. 10 and compound of formula (2d) [1:1 weight ratio] | 0.1 g | B |
| Mixture of compound of Prep. Ex. 2 and compound of formula (2e) [1:1 weight ratio] | 0.2 g | B |
| Mixture of compound of Prep. Ex. 13 and compound of formula (2f) [1:1 weight ratio] | 0.4 g | B |
| Mixture of compound of Prep. Ex. 13 and compound of formula (2b) [1:1 weight ratio] | 0.3 g | B |

As to the constitution of compound of formula (107) see Application Example 1.

What is claimed is:

1. A detergent composition comprising at least one compound of formula (1)

(1)

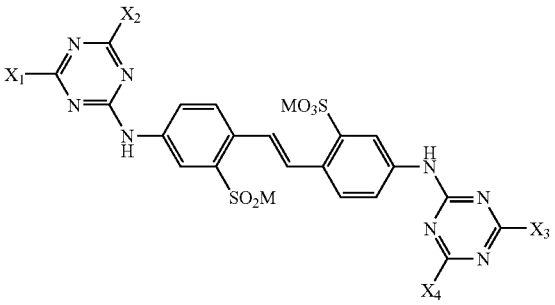

wherein $X_1$ and $X_3$ are $NH_2$, and $X_2$ and $X_4$ are a radical of formula —$N(R_1)R_2$, wherein $R_1$ and $R_2$ are hydrogen; unsubstituted or COOH or CN substituted methyl; $CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and M is hydrogen or a cation, together with at least one compound of formula (2)

(2)

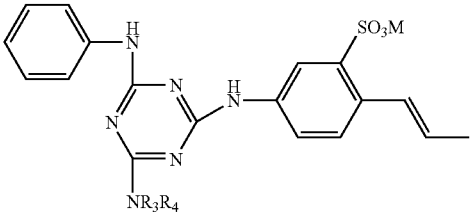

-continued

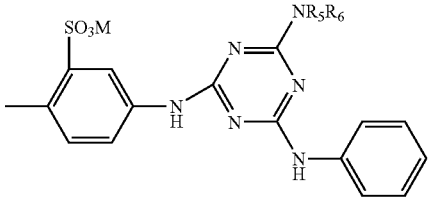

wherein $R_3$ and $R_5$, independently from each other, are hydrogen; unsubstituted $C_1$-$C_8$alkyl or substituted $C_1$-$C_8$alkyl, $R_4$ and $R_6$, independently from each other, are hydrogen; unsubstituted phenyl; unsubstituted $C_1$-$C_8$alkyl or substituted $C_1$-$C_8$alkyl, or $NR_3R_4$ and/or $NR_5R_6$ form an unsubstituted or substituted morpholino ring, and M is hydrogen or a cation.

2. A detergent composition according to claim 1, wherein $R_3$ and $R_5$, independently of each other, are hydrogen; unsubstituted $C_1$-$C_4$alkyl or substituted $C_1$-$C_4$alkyl, $R_4$ and $R_6$, independently of each other, are unsubstituted phenyl; unsubstituted $C_1$-$C_4$alkyl or substituted $C_1$-$C_4$alkyl, or $NR_3R_4$ and/or $NR_5R_6$ form an unsubstituted or substituted morpholino ring, and M is an alkali metal atom, an alkaline earth metal atom, ammonium or a cation formed from an amine.

3. A detergent composition according to claim 1, wherein the compounds of formula (2) are those of formula (2a)

(2a)

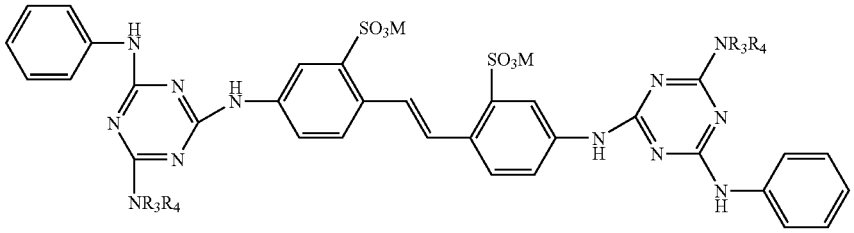

wherein $R_3$ is hydrogen; unsubstituted $C_1$-$C_2$alkyl or $C_1$-$C_4$alkyl, which is substituted by hydroxy or $C_1$-$C_4$alkoxy, $R_4$ is unsubstituted phenyl; unsubstituted $C_1$-$C_2$alkyl or $C_1$-$C_4$alkyl, which is substituted by hydroxy or $C_1$-$C_4$alkoxy, or $NR_3R_4$ forms an unsubstituted or substituted morpholino ring, and M is hydrogen or an alkali metal atom.

4. A detergent composition according to claim 1, wherein the compounds of formula (2) are selected from those of formula (2b)-(2f)

(2b)

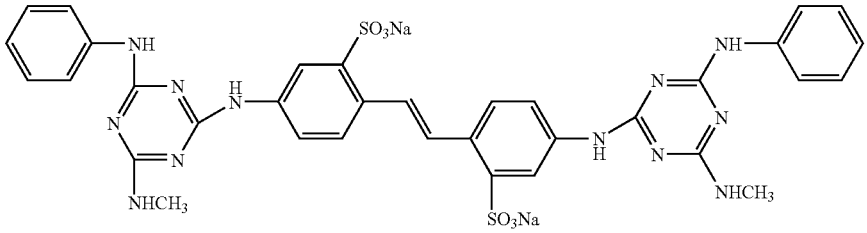

(2c)

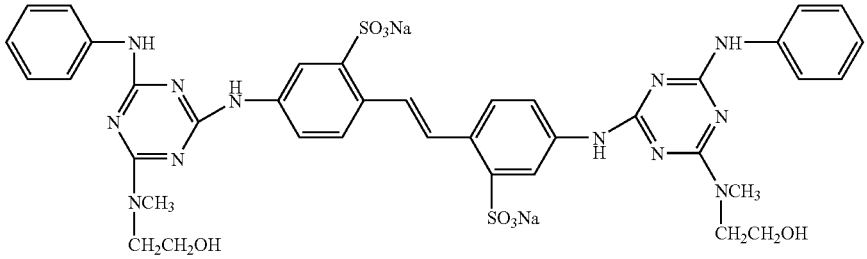

(2d)

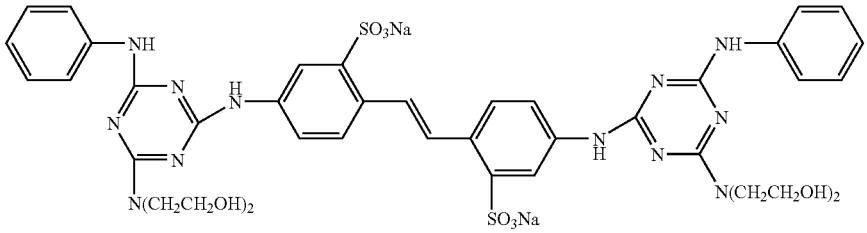

(2e)

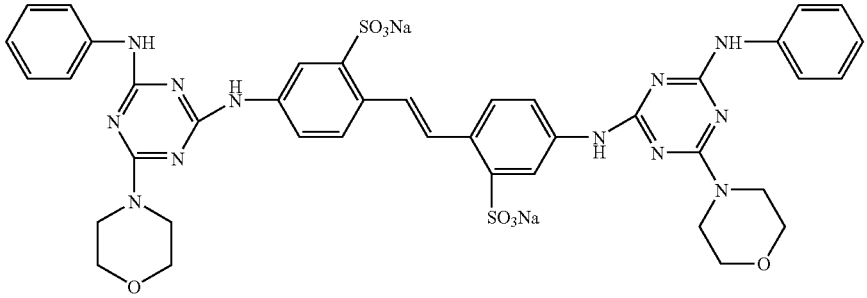

and (2f)

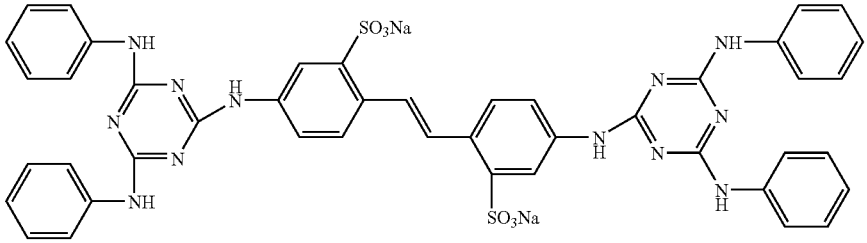

5. A detergent composition according to claim 1, comprising i) 1-70 weight-% (wt-%) of at least one anionic surfactant and/or at least one nonionic surfactant;

ii) 0-75 wt-% of at least one builder;

iii) 0-30 wt-% of at least one peroxide;

iv) 0-10 wt-% of at least one peroxide activator; and v) 0.001-5 wt-% of a mixture comprising at least one compound of formula (1) and at least one compound of formula (2) as defined in claim 1, each by weight, based on the total weight of the detergent composition.

6. A detergent composition according to claim 5, comprising i) 5-70 wt-% of at least one anionic surfactant and/or at least one nonionic surfactant;

ii) 5-70 wt-% of at least one builder;

iii) 0.5-30 wt-% of at least one peroxide;

iv) 0.5-10 wt-% of at least one peroxide activator and/or 0.1-2 wt-% of a bleaching catalyst; and v) 0.01-5 wt-% of a mixture comprising at least one compound of formula (1')

(1')

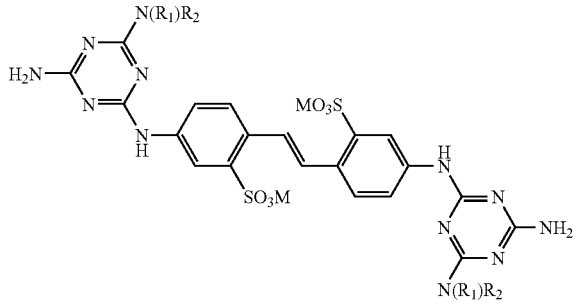

wherein $R_1$ and $R_2$ are hydrogen; unsubstituted or COOH or CN substituted methyl; $CH_2CH_2OH$;

unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and at least one compound of formulae (2b)-(2f)

(2b)

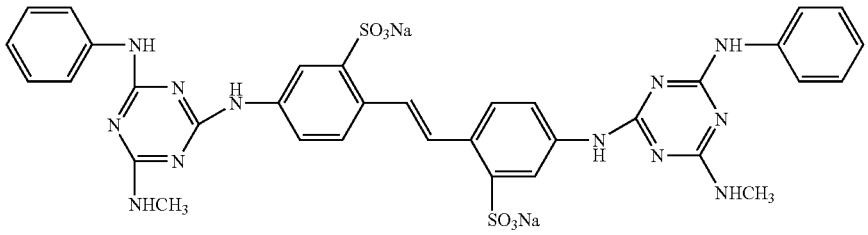

(2c)

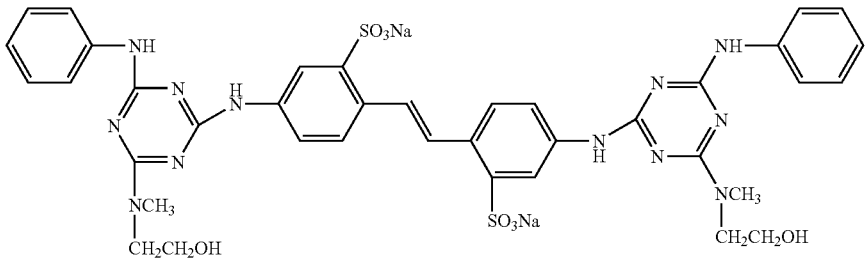

(2d)

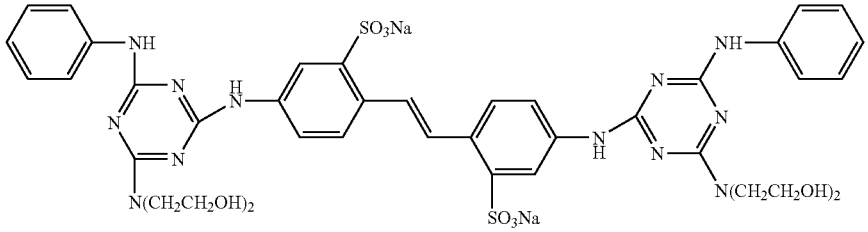

-continued (2e)

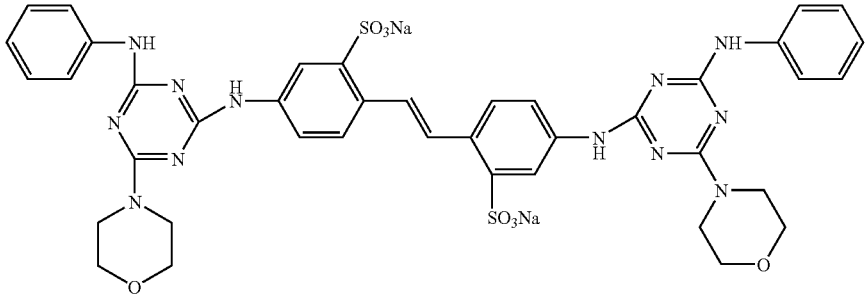

and/or (2f)

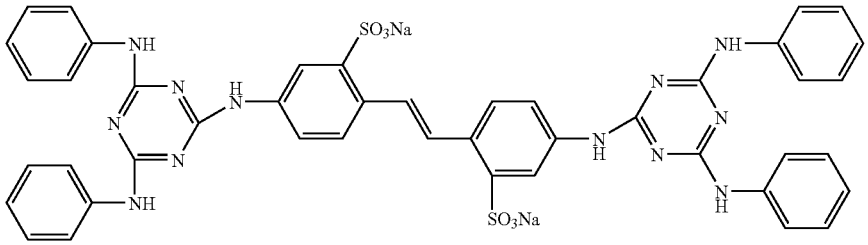

, each by weight, based on the total weight of the detergent composition.

7. A detergent composition according to claim 1 in which the detergent composition further comprises at least one enzyme selected from the group consisting of cellulase, protease, amylase and lipase.

8. A detergent composition according to claim 7, comprising i) 1-70 wt-% of at least one anionic surfactant and/or a nonionic surfactant;

ii) 0-75 wt-% of at least one builder;

iii) 0-30 wt-% of at least one peroxide;

iv) 0-10 wt-% of at least one peroxide activator;

v) 0.001-5 wt-% of a mixture comprising at least one compound of formula (1) and at least one compound of formula (2) and vi) 0.05-5 wt-% of at least one enzyme selected from the group consisting of cellulase, protease, amylase and lipase.

9. A detergent composition according to claim 7, comprising i) 5-70 wt-% of at least one anionic surfactant and/or a nonionic surfactant;

ii) 5-70 wt-% of at least one builder;

iii) 0.5-30 wt-% of at least one peroxide;

iv) 0.5-10 wt-% of at least one peroxide activator and/or 0.1-2 wt-% of a bleaching catalyst;

v) 0.01-5 wt-% of a mixture comprising at least one compound of formula (1')

(1')

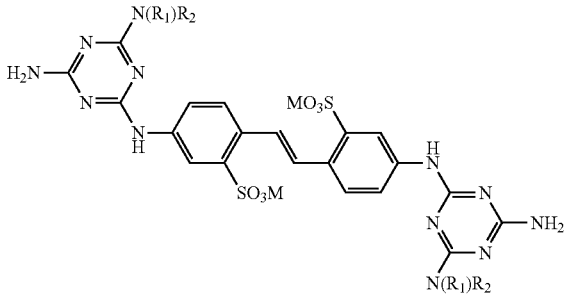

wherein $R_1$ and $R_2$ are hydrogen; unsubstituted or COOH or CN substituted methyl; $CH_2CH_2OH$;

unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and at least one compound of formulae (2b)-(2f)
(2b)
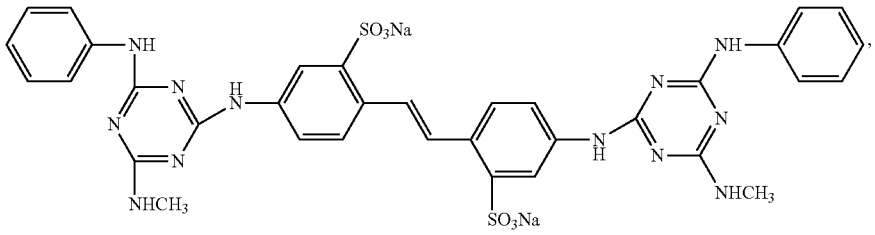
(2c)
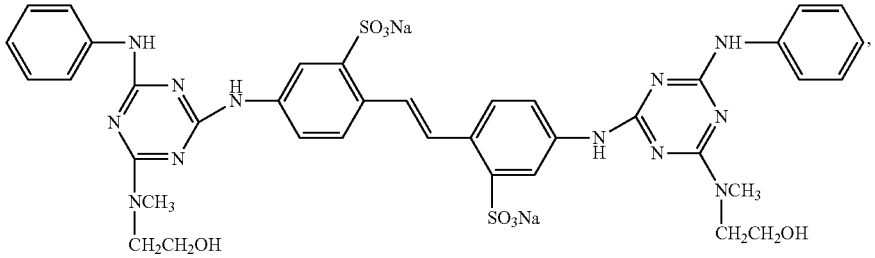
(2d)
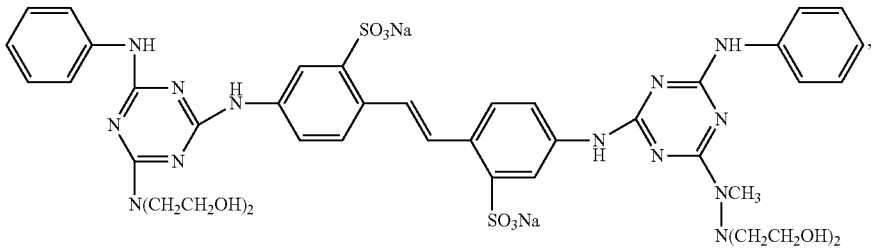
(2e)
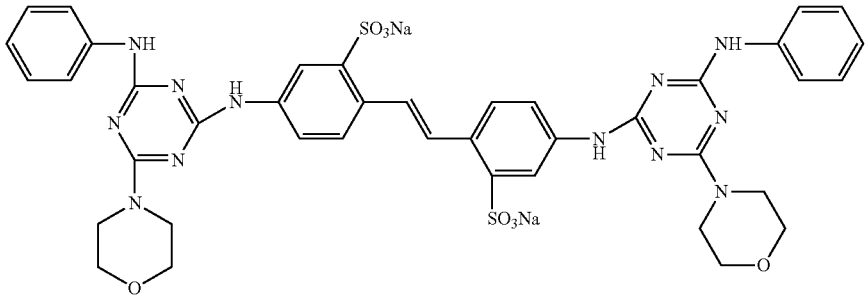
and/or
(2f)
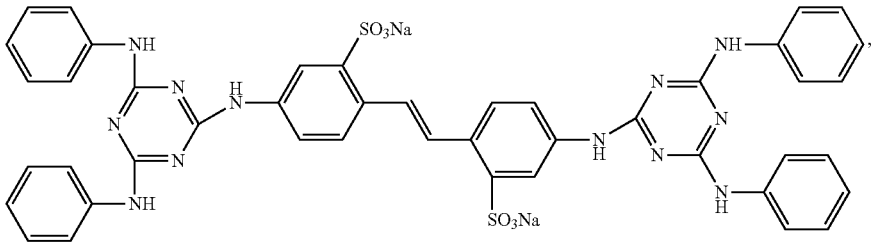
and vi) 0.05-5 wt-% of at least one enzyme selected from the group consisting of cellulase, protease, amylase and lipase.

10. A detergent composition according to claim 7, wherein the enzyme is a protease enzyme.

11. A process for the domestic washing treatment of a textile fibre material wherein the textile fibre material is contacted with an aqueous solution of a detergent composition comprising a compound of compound of formula (1)

(1)

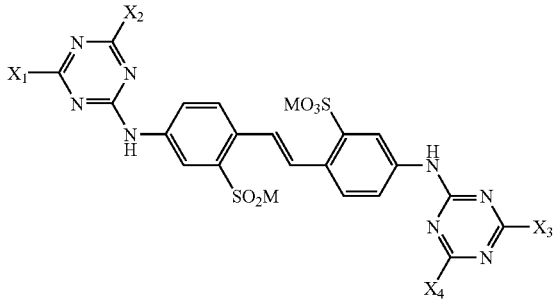

wherein $X_1$ and $X_3$ are $NH_2$, and $X_2$ and $X_4$ are a radical of formula —$N(R_1)R_2$, wherein $R_1$ and $R_2$ are hydrogen; unsubstituted or COOH or CN substituted methyl; $CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and M is hydrogen or a cation, together with at least one compound of formula (2)

(2)

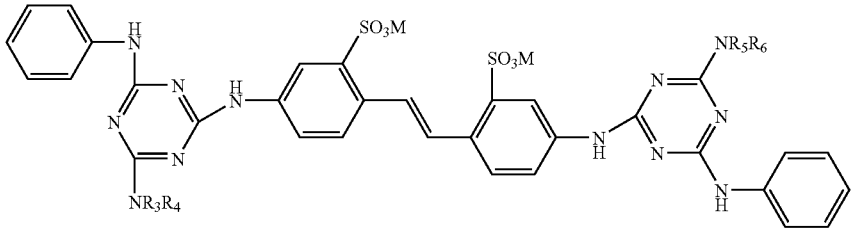

wherein $R_3$ and $R_5$, independently from each other, are hydrogen; unsubstituted $C_1$-$C_8$alkyl or substituted $C_1$-$C_8$alkyl, $R_4$ and $R_6$, independently from each other, are hydrogen; unsubstituted phenyl; unsubstituted $C_1$-$C_8$alkyl or substituted $C_1$-$C_8$alkyl, or $NR_3R_4$ and/or $NR_5R_6$ form a morpholino ring, and M is hydrogen or a cation, and wherein the detergent composition contains at least one enzyme selected from the group consisting of cellulase, protease, amylase and lipase, and wherein the temperature of the solution is between 5° C. and 40° C. throughout the process.

12. A process according to claim 11, wherein $R_3$ and $R_5$, independently of each other, are hydrogen; unsubstituted or substituted methyl, $R_5$ and $R_7$, independently of each other, are unsubstituted phenyl; unsubstituted or substituted methyl, or $NR_3R_4$ and/or $NR_5R_6$ form an unsubstituted or substituted morpholino ring, and M is hydrogen or a cation.

13. A process according to claim 11, wherein the textile fibre material is contacted with an aqueous solution of a detergent composition comprising at least one compound of formula (1')

(1')

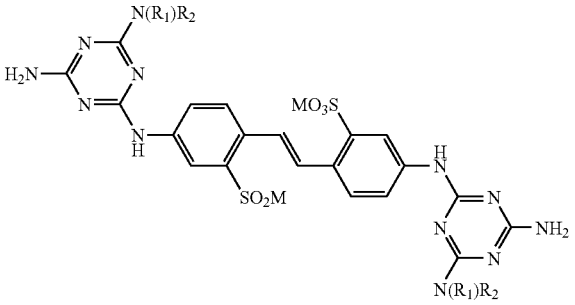

wherein $R_1$ and $R_2$ independently from each other are hydrogen; unsubstituted or COOH or CN substituted methyl; $CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and at least one compound of formulae (2b)-(2f)

(2b)
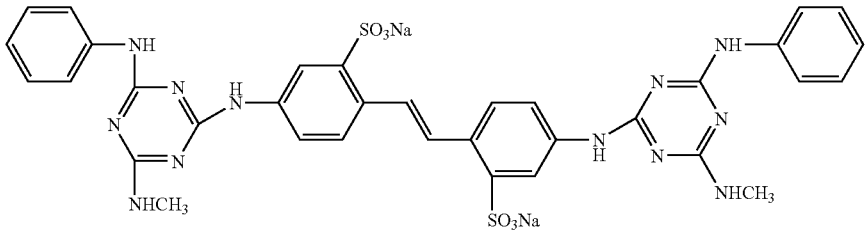
,
(2c)
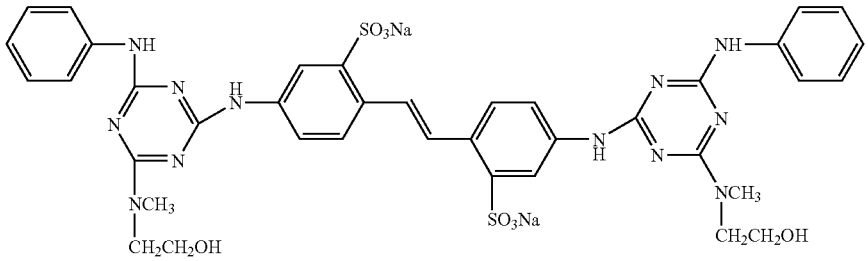
,
(2d)
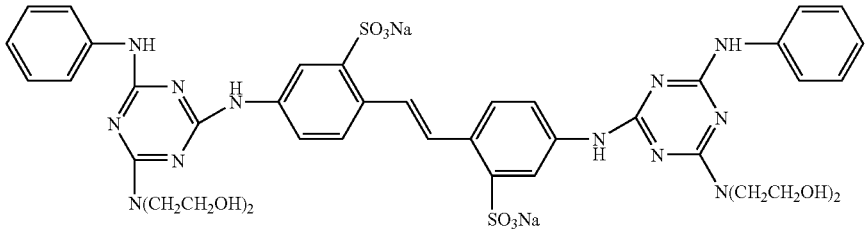
,
(2e)
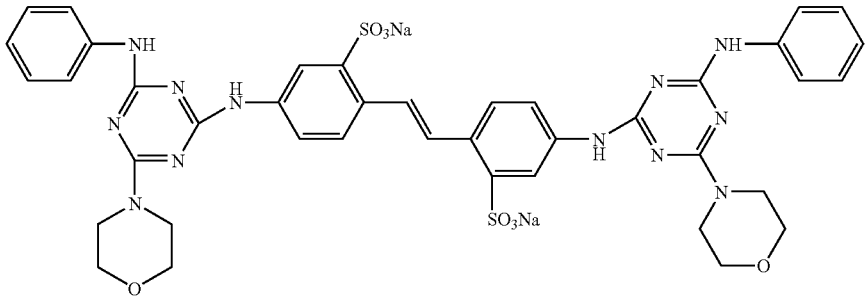
and/or -continued (2f)

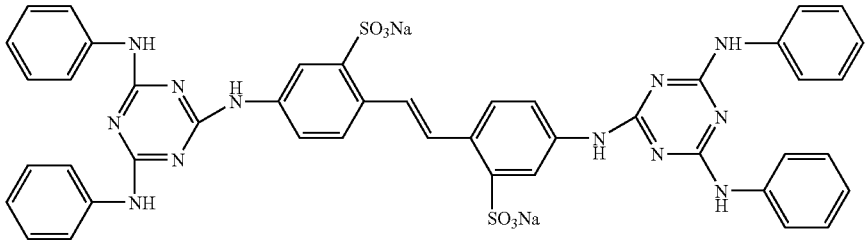

14. A mixture comprising at least one compound of formula (1)

(1)

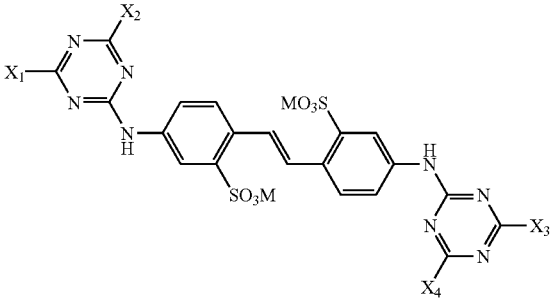

wherein $X_1$ and $X_3$ are $NH_2$, and $X_2$ and $X_4$ are a radical of formula —$N(R_1)R_2$, wherein $R_1$ and $R_2$ are hydrogen; unsubstituted or COOH or CN substituted methyl; $CH_2CH_2OH$; unsubstituted or $C_1$-$C_4$alkyl-substituted cyclopentyl or cyclohexyl, or $R_1$ and $R_2$, together with the nitrogen atom linking them, form an unsubstituted or $C_1$-$C_4$alkyl-substituted morpholino, piperidine or pyrrolidine ring, and M is hydrogen or a cation, together with at least one compound of formula (2)

wherein $R_3$ and $R_5$, independently from each other, are hydrogen; unsubstituted $C_1$-$C_8$alkyl or substituted $C_1$-$C_8$alkyl, $R_4$ and $R_6$, independently from each other, are hydrogen, unsubstituted phenyl; unsubstituted $C_1$-$C_8$alkyl or substituted $C_1$-$C_8$alkyl, or $NR_3R_4$ and/or $NR_5R_6$ form an unsubstituted or substituted morpholino ring, and M is hydrogen or a cation.

15. A mixture according to claim 14, wherein $R_3$ and $R_5$, independently of each other, are hydrogen; unsubstituted $C_1$-$C_4$alkyl or substituted $C_1$-$C_4$alkyl, $R_4$ and $R_6$, independently of each other, are unsubstituted phenyl; unsubstituted $C_1$-$C_4$alkyl or substituted $C_1$-$C_4$alkyl, or $NR_3R_4$ and/or $NR_5R_6$ form an unsubstituted or substituted morpholino ring, and M is hydrogen or a cation.

16. A mixture according to claim 14, wherein $R_3$ and $R_5$, independently of each other, are hydrogen; unsubstituted $C_1$-$C_2$alkyl or $C_1$-$C_4$alkyl, which is substituted by hydroxy or $C_1$-$C_4$alkoxy, $R_4$ and $R_6$, independently of each other, are unsubstituted phenyl; unsubstituted $C_1$-$C_2$alkyl or $C_1$-$C_4$alkyl, which is substituted by hydroxy or $C_1$-$C_4$alkoxy, or $NR_3R_4$ and/or $NR_5R_6$ form an unsubstituted or substituted morpholino ring, and M is hydrogen or a cation.

17. A mixture of compounds according to claim 14, wherein the compounds of formula (2) are those of formula (2a)

(2)

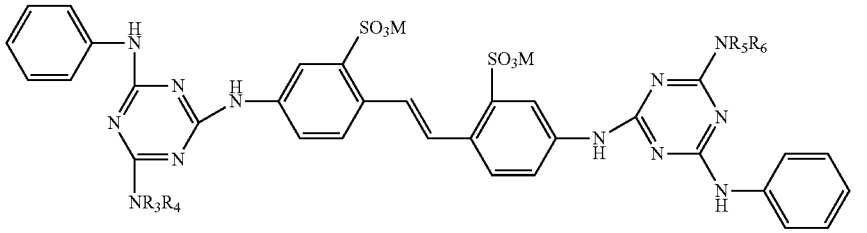

(2a)

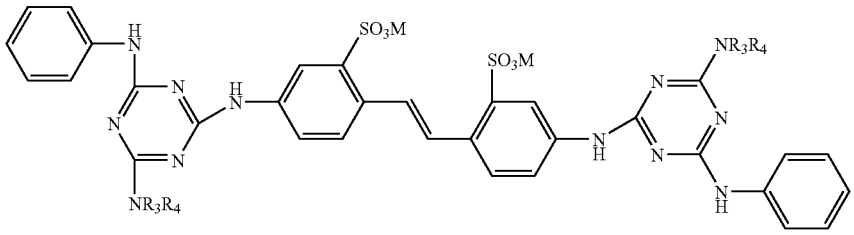

wherein $R_3$ is hydrogen; unsubstituted $C_1$-$C_2$alkyl or $C_1$-$C_4$alkyl, which is substituted by hydroxy or $C_1$-$C_4$alkoxy, $R_4$ is unsubstituted phenyl; unsubstituted $C_1$-$C_2$alkyl or $C_1$-$C_4$alkyl, which is substituted by hydroxy or $C_1$-$C_4$alkoxy, or $NR_3R_4$ forms an unsubstituted or substituted morpholine ring, and M is hydrogen or a cation.

18. A mixture according to claim 14, wherein

M is hydrogen, an alkaline- or alkaline earth-metal, or ammonium.

19. A mixture of compounds according to claim 14, wherein the compounds of formula (2) are selected from those of formula (2b)-(2f)

(2b)

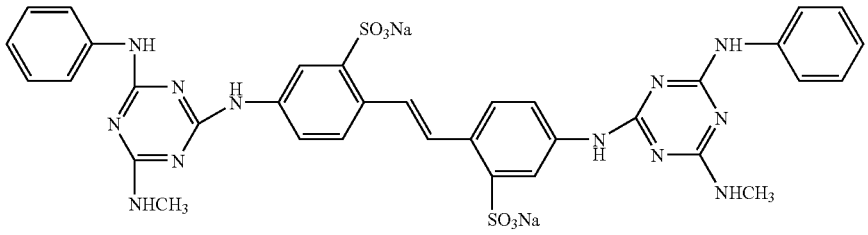

, (2c)

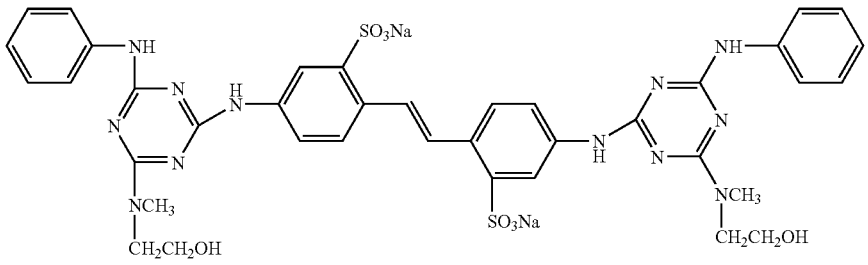

, (2d)

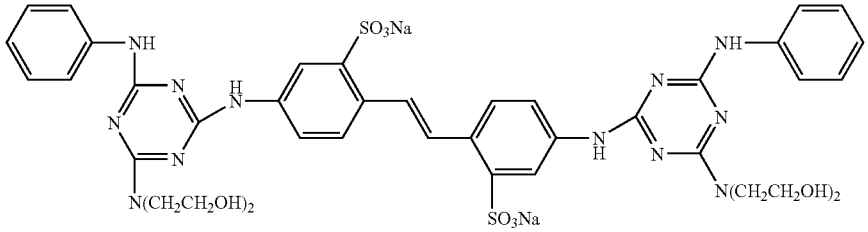

,

-continued
(2e)
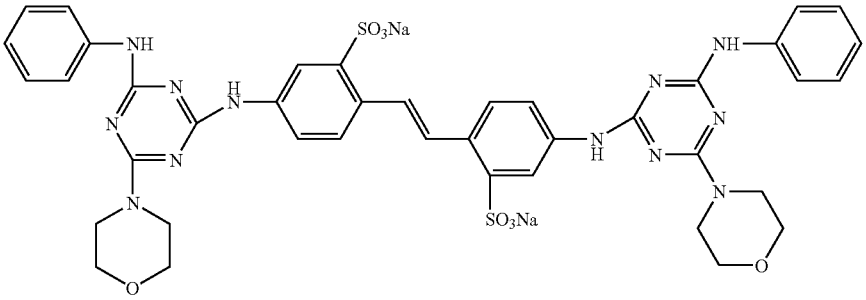
and/or
(2f)
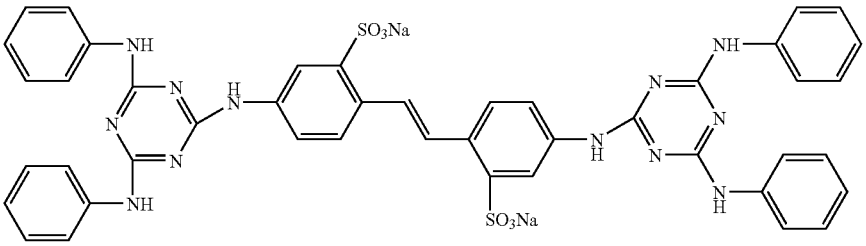
.
* * * * *